United States Patent [19]

Haulsee et al.

[11] Patent Number: 4,996,865

[45] Date of Patent: Mar. 5, 1991

[54] APPARATUS FOR FORMING ONE-PIECE METAL CAN BODIES

[75] Inventors: Donald R. Haulsee, Chesterfield County; Herman J. Steinbuchel, Chesterfield; Sandra K. Wallace-Daye, Colonial Heights; Brian L. Matthews, Chester, all of Va.

[73] Assignee: Reynolds Metals Company, Richmond, Va.

[21] Appl. No.: 459,995

[22] Filed: Jan. 5, 1990

[51] Int. Cl.[5] ..... B21D 22/28

[52] U.S. Cl. ..... 72/349; 72/449; 72/456

[58] Field of Search ..... 72/349, 449, 456; 384/12; 74/52

[56] References Cited

U.S. PATENT DOCUMENTS

| | | | |
|---|---|---|---|
| 2,338,352 | 1/1944 | Paque | 74/52 |
| 2,506,736 | 5/1950 | Oschwald | 74/52 |
| 3,635,532 | 1/1972 | Zerbola | 384/12 |
| 4,578,981 | 4/1986 | Nishikawa et al. | 72/349 |

*Primary Examiner*—Lowell A. Larson

[57] ABSTRACT

A horizontally movable ram and crank drive mechanism therefor for reciprocating the working end of the ram in straight line motion through a die pack for ironing and drawing metallic can bodies is disclosed. The ram is supported by a hydrostatic type bearing support assembly to counteract gravitational vertical deflection of the unsupported working end of the ram. A cardan type crank drive mechanism for converting rotational input force into straight line reciprocating movement of an output shaft is also disclosed.

43 Claims, 11 Drawing Sheets

APPARATUS FOR FORMING ONE-PIECE METAL CAN BODIES

TECHNICAL FIELD

The present invention generally relates to apparatus for forming one-piece metallic can bodies and, more particularly, to apparatus utilizing a reciprocal ram, with hydrostatic-hydrodynamic type bearing support for the ram, movable through a die pack for forming one-piece metallic can bodies during the working stroke of the ram and a mechanical crank drive assembly for reciprocating the ram at high speed.

BACKGROUND ART

Apparatus for forming one-piece metallic can bodies are known and typically comprise a reciprocating movable ram movable through a relatively long forward working stroke and a rearward return stroke via a mechanical drive having an output shaft driven in reciprocating straight line motion and connected to the non-working end of the ram to reciprocate same. Prior to commencement of the working stroke, a can blank having a cylindrical side wall and integral bottom wall is positioned, using known indexing means, in the path of the ram to engage the working end entering the can through its open top at the commencement of the working stroke. The working end drives the can blank at high speed through a precisely aligned die package. As the metallic can enters the die package, its bottom end first, a drawing action occurs followed by an ironing action. A redraw die reduces the can diameter as the can is pulled by the ram through the die opening. The ironing die thins the metal can side walls by squeezing the metal between two surfaces to lengthen the can body. A pilot die helps to minimize thickness variation in the irregular can edge by supporting the ram punch as the irregular edge passes through a middle ironing die. In the final steps of the process, at the end of the working stroke, the ram working end or punch strikes a bottom former to shape a concave dome in the can bottom. The foregoing die pack comprising drawing and ironing dies, a pilot die and bottom former are conventional and may be arranged in various configurations. Critical, however, is the requirement that the die package be perfectly centered on the ram drive axis with precise tolerances between the ram and die package.

The reciprocating ram is typically supported in a mechanical rolling element bearing support or a hydrostatic type bearing support assembly wherein the ram movements are supported on constantly pressurized and flowing, thickened bearing oil films for maximum movement accuracy and minimum wear. At reduced speeds of ram movement such as during commencement and termination of the working and return strokes, the hydrostatic type bearing supports generally provide sufficient hydrostatic type support since the pressurized oil films supplied to the outer surface of the ram through hydrostatic pressure pad slots formed in the bearings through which the ram moves are capable of flowing circumferentially about the ram so as to center the ram within the bearing. However, at high speeds of ram movement during the working and return strokes, this circumferential flow is somewhat disrupted by the high axial component of velocity of the ram moving through the bearings. Therefore, at relatively high ram speeds during working operations, there may be a partial or complete failure in the ability of the bearings to provide hydrostatic bearing support which may result in complete bearing failure or early bearing fatigue necessitating frequent replacement or repair of the bearings. Such bearing fatigue also adversely effects the ability of the bearings to support the ram during its reciprocal movements while maintaining repeated trueness of movement with minimum wear for maximum quality of finished can bodies.

Another problem associated with hydrostatic type bearing support systems for a reciprocal ram of which I am aware is that the unsupported, overhanging working end portion of the ram (i.e., which extends outwardly from the bearing support and therefore only supported at the bearings) is the natural tendency of the working end to vertically deflect due to its own weight, with the amount of downward deflection due to gravity of the overhanging portion varying with the fourth power of the length of overhang. In other words, the vertical deflection of the ram working end increases as the ram progresses in its working stroke towards the die package. In multiple stage can drawing and ironing operations wherein the ram must be extended or projected within the dies over a long unsupported distance, such large vertical deflections cannot be tolerated if the necessary trueness, quality and metal wall constant thickness and completed part surface finish is to be maintained. Heretofore, in the prior art of which I am aware, this problem of natural vertical deflection due to inadequate ram bearing support has either been an operational speed limiting factor if frequent failures and maintenance interruptions for bearing replacements are to be avoided, or has resulted in limiting the length of the working stroke and therefore the length of can bodies that may be manufactured with such a drawing and ironing process.

A known mechanical drive of which I am aware for reciprocating the ram in straight line high speed movement in a horizontal plane generally comprises a crank shaft, rotating in a bearing set, and formed with a throw at one end thereof to which is connected a connecting rod driven by the crank shaft. The horizontal drive axis of the crank shaft is located below the horizontal plane of movement of the reciprocating ram. A pivoting beam is connected to the other end of the connecting rod at an intermediate portion of the rod and below the horizontal plane of ram movement. The lower end of the vertically extending pivoting beam is pinned to a machine base and the upper end of the beam in the horizontal plane of ram movement is connected to the ram with a connecting link. The ram is constrained to move horizontally via a slide way.

In the known crank drive described above, the only rotating part is the crank shaft; all the other aforesaid parts reciprocate. Balancing of this mechanism is accomplished with additional throws to move additional connecting rods and beams in a direction opposite to that of the ram. All of these balancing parts also reciprocate.

Since the reciprocating parts of the crank drive mechanism are located at the distal end of the crank shaft remote from the support bearing set, substantial cantilevering forces result which cause the crank shaft and reciprocating mechanism to experience internal bending transmitted to the output shaft; this causes the ram to deflect from its straight line motion, particularly within the horizontal plane. Further, since the mechanical parts of the prior art crank drive are subject primarily to reciprocating movement and not rotational movement (only the crank shaft rotates), the amount of input energy that must be dissipated each time the reciprocating parts reverse their direction at each end of the stroke is large and, since the input energy is dissipated through an external flywheel, the flywheel size is resultingly great, i.e., the rotating inertia of the flywheel is approximately three times as great as the flywheel used in the present invention.

DISCLOSURE OF THE INVENTION

It is accordingly one object of the present invention to provide apparatus for forming one-piece metallic can bodies wherein the reciprocal ram performing the working operations is mechanically driven to gain inherent advantages of such mechanical drive, yet through a unique form of mechanical crank linkage eliminating cantilevered and internal bending loads that would otherwise induce undesirable deflection of the ram in horizontal and/or vertical planes.

Another object of this invention is to provide a unique ram hydrostatic support system that eliminates inherent vertical deflection of the unsupported, overhanging working end of the ram due to gravity.

Still a further object of the invention is to provide a ram bearing support system enabling the ram to be properly centered and supported through hydrodynamic and hydrostatic bearing sections which become separately operational as a function of the speed of operation of the ram in its forward and rearward working and return strokes.

Yet another object of this invention is to provide a crank drive unit converting rotary motion into straight line reciprocating motion in both metallic can body forming operations as well as other types of operations.

Another object is to provide a bearing system for a reciprocating member for both metallic can body forming operations as well as other applications involving the use of a reciprocating member.

Still a further object is to provide a crank drive system for converting input rotary motion into straight line reciprocating motion wherein virtually all moving parts of the crank drive mechanism move rotationally, not reciprocally, so as to reduce the amount of input energy that must be dissipated each time a reciprocating part reverses its direction at each end of the stroke.

Apparatus for forming metallic parts, in accordance with one feature of the present invention, comprises a reciprocating ram and a driving mechanism for moving the ram in forward and rearward reciprocating strokes. The ram is adapted to have a metal part positioned to be engaged by a forward working end of the ram and formed by the working end in its working stroke. The ram is supported for sliding reciprocating movement in a hydrostatic bearing system including at least a pair of hydrostatic bearings. The ram working end, in its extended position from the bearings in the working stroke, defines an unsupported, overhanging portion. To prevent vertical deflection of the unsupported, overhanging portion, such as induced by gravity, a system is provided for applying a deflection force against the ram, between the bearings, to induce a desired degree of deflection in the working end which restores the ram working end back towards the horizontal plane of movement.

The system for deflecting the ram may apply a substantially constant force to the ram, between the bearings, independent of the position of the ram working end in its working or return strokes. Alternatively, the deflection force applying system may apply a variable force to the ram as a function of the position of the working end, relative to the bearing system, in the working and return strokes.

In the preferred embodiment, the deflection force applying system applies the deflection force downwardly against the ram between the bearings to cause the ram to bend upwardly between the point of application of the force and the working end. The deflection force applying system is preferably a center bearing, located in the bearing housing between the end bearings, against which center bearing the deflection force is applied via a piston and cylinder arrangement.

More specifically, each front and rear bearing includes a bearing sleeve and a concentric bushing within the sleeve through which the ram is adapted to reciprocate. An inner cylindrical surface of each bushing includes a plurality of circumferentially spaced slots extending longitudinally in the direction of ram movement, to which slots pressurized oil is supplied to thereby define elongate hydrostatic pressure pads opposing the outer surface of the ram. The opposite ends of each hydrostatic pressure pad slot terminate within the bushing and plural, longitudinally extending drain slots are respectively disposed between the pressure pad slots to receive the pressure oil flowing circumferentially therein from the adjacent pressure pad slots. This arrangement of pressure pad slots and drain slots results in a pressure distribution that both lifts and centers the ram within the bearings.

In accordance with another feature of the invention, the end portion of each bushing has a decreased bushing inner diameter in relation to the intermediate larger inner diameter portion of the bushing adjacent the end portions. The decreased diameter end portions are configured to effectively function as dams minimizing axial oil flow to thereby ensure improved bearing support during reciprocating ram movement.

More specifically, the, decreased diameter end portions of the bearing bushings define stepped ends establishing hydrodynamic end sections in each bearing. When the axial velocity of the non-rotating ram is at a predetermined low speed, the combination of the hydrostatic pressure pad slots and the drain slots center the ram and, below such predetermined low speed, the hydrodynamic sections have substantially no hydrodynamic effect. When the non-rotating ram speed is above the predetermined low speed, at which speed the axial flow of oil through the bearing tends to disrupt hydrostatic performance, the axial flow creates a hydrodynamic step proximate the stepped bearing ends which provide a centering force maintaining the ram in its substantially centered position until the ram velocity drops to or below the predetermined low speed at which lower speeds the hydrostatic sections again become effective.

The center or intermediate bearing is also advantageously and preferably formed with an arrangement of hydrostatic pressure pad slots, drain slots and hydrodynamic stepped sections substantially identical to the corresponding parts of the end bearings. Preferably, however, the center or intermediate bearing is formed with a pair of bushings, longitudinally spaced from each other on the ram and within the center bearing sleeve, with each bushing formed with the stepped ends and hydrostatic pressure pad slots described above.

The center or intermediate bearing is retained in an axially stationary position within the bearing housing and the outer diameter of the sleeve is spaced from the inner diameter of the housing so as to enable the center bearing to be movable in a floating state in the radial direction by virtue of the resulting clearance between the housing inner surface and intermediate bearing sleeve outer surface. The deflection cylinders are mounted in an upper wall portion of the bearing housing and have their piston rods extending through the housing into intimate contact with an upper surface of the intermediate bearing sleeve. Thereby, actuation of the cylinders causes the piston rods to extend and impart a deflection force or load against an upper surface of the bearing sleeve which is transmitted to the reciprocating ram through the intermediate bearing bushing so as to force the ram to "bow" downward between the end support bearings, creating an upward deflection of the ram within the end bearings that tends to lift the overhanging working end portion of the ram.

The above invention also contemplates the use of the hydrostatic bearing system of the invention for applications other than for forming metallic parts or cans wherein said other applications require the use of a reciprocating ram or member supported by a hydrostatic bearing system. Optionally, and largely as a function of the operating speed of the ram, the hydrostatic bearing system may be provided without the hydrodynamic bearing sections but with the deflection force applying means of the types disclosed in this application and their equivalents. In the alternative, in situations where downward deflection of the ram overhanging end portion is not critical, and preferably in situations where the ram reciprocates at high speed, the invention also contemplates use of a hydrostatic bearing support system wherein the end bearings are formed with both hydrostatic pressure pad slots and hydrodynamic stepped end sections but without the deflection force applying means. Optimally, however, both the deflection force applying means and the hydrostatic bearings with hydrodynamic stepped end sections are provided within a hydrostatic bearing support system to gain the advantages of both.

To eject the formed can from the working end of the ram after passage through the die package, pressurized air is supplied through the central air tube extending through the ram in communication with the working end. The pressurized air is provided through an air line connected to a stationary air distribution manifold mounted to the rear end of the bearing housing assembly. As the working end of the ram reaches its front dead center position, a series of radial holes and grooves in the ram non-working end align with the manifold so as to enable the pressurized air to enter the air tube through a one-way check valve housing in the ram non-working end. The air then flows through the check valve and is directly through axial passages in the non-working end into the air tube to blow the can off. Air is only supplied into the air tube when the ram is at its front dead center. The check valve maintains air pressure as the ram retracts. The check valve is structured so that its inertial forces ensure that it remains shut until approximately mid-way through the return stroke, well after the can has been blown off the punch at the ram working end. With this arrangement, flexible hoses and rotary unions are not required.

In accordance with another feature of the present invention, the mechanism for reciprocating the ram in a straight line path preferably comprises a cardan type gearing arrangement wherein a primary crank shaft is mounted with a pair of inboard and outboard primary crank shaft bearings in a crank shaft housing for rotation about a drive axis L1 via an input shaft connected to a motor drive at an inboard end thereof. A secondary crank shaft is eccentrically mounted to the primary crank shaft for rotation about drive axis L1 while being rotated about its offset axis of rotation L2 which is parallel to axis L1. A stationary ring gear is mounted in the crank shaft housing and a pinion is mounted on the secondary, crank shaft in meshing contact with the stationary ring gear. The secondary crank shaft is formed with a throw or crank portion at a forward end thereof to which is mounted an output shaft. Rotation of the primary crank shaft about its rotational axis L1 causes the pinion to roll along the ring gear and thereby rotate the secondary crank shaft about axis L2 in a rotational direction opposite the rotational direction of the primary crank shaft, while revolving about axis L1. In accordance with cardan gearing principles, the combined motions of the primary crank shaft and secondary crank shaft and pinion result in straight line reciprocating motion of the output shaft.

The outboard primary crank shaft bearing is preferably a large diameter bearing mounted in the crank shaft housing at a forward end thereof adjacent the path of straight line motion of the output shaft. The diameter of the outboard primary crank shaft bearing is larger than or equal to the pitch diameter of the ring gear (which determines the length of stroke of the output shaft and therefore the ram). The feature of an outboard primary crank shaft bearing having such diametral characteristics advantageously enables the outboard primary crank shaft bearing to be located immediately adjacent the path of straight line motion and, therefore, cantilevering effects otherwise acting on the output shaft and internal bending loads within the mechanism are minimized or virtually eliminated.

To enable straight line motion of the output shaft to occur in accordance with cardan gearing principles, the pitch diameter of the pinion and the pitch diameter of the ring gear are in the ratio of 1:2. The output axis of the eccentric output shaft lies on the pitch circle of the pinion.

In accordance with another feature of the invention, the secondary crank shaft is preferably mounted for rotation within the primary crank shaft by means of inboard and outboard secondary crank shaft bearings contained within a longitudinally extending, eccentrically offset cavity formed in a forward body portion of the primary crank shaft along axis L2. The body portions of the primary crank shaft defining the cavity and extending transversely or radially towards axis L1 effectively constitutes a primary throw or crank arm of integral construction within the primary crank shaft. The pinion mounted on the secondary crank shaft within the cavity projects laterally outwardly through an opening formed in the side wall of the primary crank shaft defining the cavity for mesh with the inner teeth of the stationary ring gear. The forward end of the secondary, crank shaft, projecting forwarding from the cavity and the front face of the primary crank shaft, defines a second throw or second crank arm of integral construction with the secondary crank shaft. The output shaft is formed at the distal end of the second crank arm. The output shaft longitudinal axis is parallel to axis L1.

In accordance with another feature of the invention, the primary crank shaft is preferably of two-part construction, a rear part perfectly centered on drive axis L1 which defines the input shaft, and a larger diameter front part which houses the secondary crank shaft and inboard and outboard secondary crank shaft bearings. Advantageously, the front or first primary crank shaft part is made of a lighter material than the rear part to thereby reduce the moment of inertia of the rotating parts and minimize bearing fatigue.

In accordance with another feature of the present invention, an arrangement of connecting passageways is preferably provided within the crank shaft housing, an input shaft housing containing the primary crank shaft rear part and connected to the back wall of the crank shaft housing, within the body portions of the front and rear parts of the primary crank shaft and in the second throw which, in combination with a unique placement of clearance bushings, enables pressurized lubricating oil to be supplied to all moving parts within the mechanism without the need for numerous rotary unions and plural flexible oil supply lines.

In accordance with another unique feature of the present invention, a pair of balancing counter-weights are respectively secured to the front face of the primary crank shaft and the second crank portion of the secondary crank shaft extending transversely and forward of the primary crank shaft so as to eliminate any external inertial forces as well as any overhanging loads created by the mass of the eccentric secondary crank during operation of the drive unit. The primary crank shaft counter-weight is preferably sector-shaped (truncated) and defined by an outer circumferential edge generally coextensive with the circumference of the primary crank shaft housing, and an inner circumferential edge bolted to the front face of the primary crank shaft diametrically opposed to the second crank shaft. The secondary crank shaft counter-weight is also sector-shaped (truncated) and formed with an outer circumferential edge having the same radius of curvature as the inner circumferential edge of the primary crank shaft counter-weight and an inner circumferential edge bolted to the front face of the offset crank portion of the secondary crank shaft. The primary and secondary crank shaft counter-weights are coplanar and the mass and centroid of the primary counter-weight is chosen so that when the reciprocating ram is attached to the output shaft of the secondary crank shaft, all horizontal imbalancing forces are cancelled. Likewise, the secondary crank shaft counter-weight and the mass and centroid thereof are chosen to remove all vertical imbalancing forces during the operation of the crank drive mechanism. To balance the mechanism, the centroid of the secondary crank shaft counter-weight must be $\frac{1}{4}$ of the mechanism stroke away from the center line axis L2 of the secondary crank shaft and the mass of the secondary crank shaft counter-weight must equal the mass of the reciprocating ram.

Still other objects and advantages of the present invention will become readily apparent to those skilled in this art from the following detailed description, wherein only the preferred embodiments of the invention are shown and described, similarly by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1B:
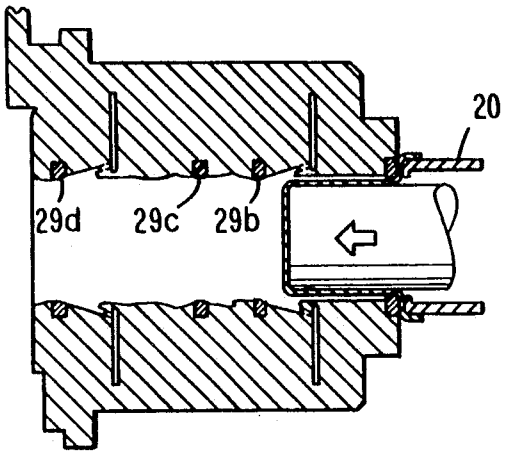
FIGS. 1A–1D are illustrations, partly schematic and partly sectional, of a die package for forming metal cans with the ram and work drive mechanism of the present invention.
Figure 1D:
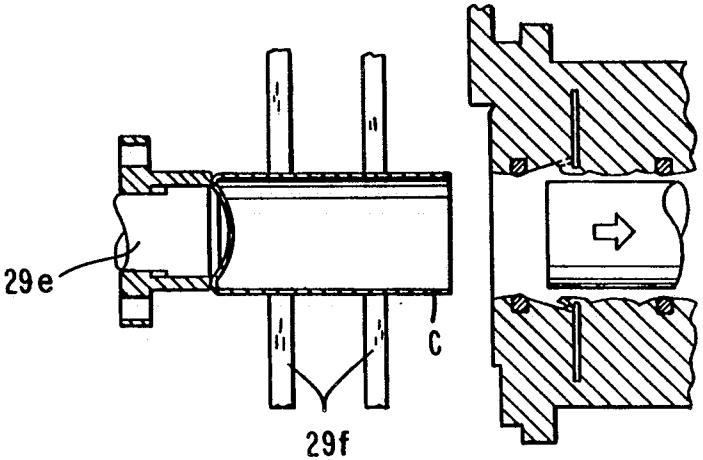

An embodiment of the overall assembly of the apparatus for forming one piece metallic can bodies C, incorporating the principles of the present invention, generally comprises two components: a sliding ram unit 10 having a horizontally reciprocating ram 12 for directing cylindrical can blanks C′ fed onto the working end 18 through a die package D where the can is formed into a desired shape: and a crank drive assembly 120 for reciprocating the ram in a horizontal straight line motion along axis A. The main drive for the crank 120 is supplied by an electric drive motor through a conventional variable speed drive, the variable speed drive in turn through conventional mounting driving a flywheel mounted on the input shaft of the crank drive assembly.

Hydrostatic Sliding Ram Unit

Referring to FIGS. 1A–1D and 2, a sliding ram unit 10 comprises a hydrostatic ram 12 with a ram clevis 14 at the non-working end thereof adapted for connection to a crank drive assembly 120 of the invention which reciprocates the hydrostatic ram at high speed along horizontal drive axis A. The ram 12 is slidably disposed and supported by a unique hydrostatic bearing system 16 capable of exerting a downward force F (FIG. 4) to make the unsupported, overhanging end portion 18 of the ram lift to thereby reduce or substantially entirely eliminate the downward deflection due to gravity of the overhanging portion as discussed more fully below. The unsupported, overhanging end portion 18 of ram 12 reciprocates between its extended, front dead center position of FIG. 1D and its inner retracted position (not shown in detail) within cylindrical cup holder sleeve support 20. The support 20 is attached to the front end of bearing housing 22 with an annular end cap 24 bolted to the housing and an annular socket 25 bolted to the cap. A wiper retainer ram seal 27 is mounted to the inner periphery of the support, outwardly adjacent the end cap, and in sealing wiping contact with the ram.

Figure 1A:
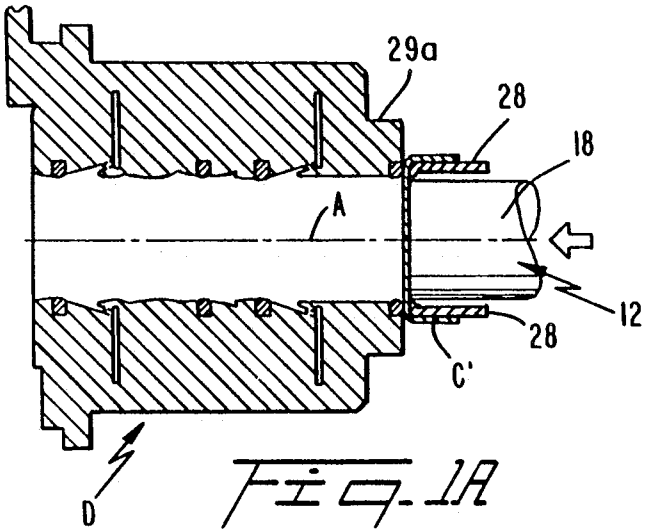
Figure 1C:
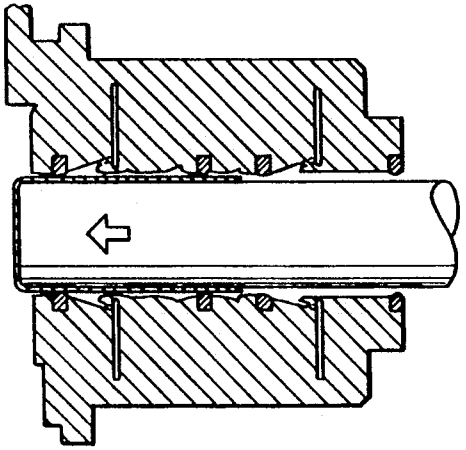

In a preferred mode of operation such as in the manufacture of aluminum cans, cylindrical can blanks are conventionally fed with a known indexing mechanism (not shown) onto the forward end of a cylindrical cup holder sleeve 28 slidably mounted to project forwardly from the cup holder sleeve support 20; the cup holder sleeve is movable by a known parallel index drive (not shown) moving the cup holder sleeve in synchronism with the reciprocating ram. After feeding the metallic can blank onto the forward end of cup holder sleeve 28, the working end of the ram is advanced, at the commencement of the working stroke, into the can blank so that a punch 18' at the forward end of the ram contacts the bottom inner surface of the can. With reference to FIG. 1A, the cup holder sleeve presses the can blank against the face of the redraw die 29*a* and the punch 18' moves into the die package 25, drawing the can C' past the redraw die 29*a* and towards the middle ironing die 29*b* (FIG. 1B). A pilot die 29*c* protects the end ironing die 29*d* from lumps of metal. The can body C' is ironed by both the middle and ironing dies 29*b*,29*d*. After forming, the can base is advanced by the punch 18' against the base former plug 29*e* at which point the ram is in its fully extended dead center position with the formed can body C located within a plurality of star wheels 29*f*. In this position, a unique blowoff system 30 discussed more fully below supplies pressurized air through the ram 12 to blow or strip the formed can from the punch, leaving the formed can body C in the star wheel mechanism 29*f* before the working end of the ram returns through die package 25 to its inner retracted position within the cup holder sleeve support 20. The star wheel mechanism then rotates to advance the formed can to a subsequent station.

In a ram 12 reciprocating horizontally at high speed, the unsupported, overhanging end portion 18 of the ram is subjected to vertical deflection by its own weight where the amount of vertical deflection varies with the fourth power of the length of the overhang in relation to the location of the hydrostatic bearing system 16 supporting the ram. For example, a change in twice the overhang length (i.e., as the ram 12 moves in its extending stroke) produces sixteen times the vertical deflection. In applications such as drawing and ironing of aluminum cans in die package 25, large vertical deflections from axis A cannot be tolerated since the tolerances between the coaxially aligned ram and die package 25 are on the order of 0.0035 inches. Therefore, uncontrolled vertical deflection was limited in the prior art hydrostatic bearing systems of which I am aware by limiting the amount of ram overhang and thereby the length of cans which can be produced in the aforesaid drawing and ironing process. The hydrostatic bearing system 16 of the present invention as will be seen more fully below, reduces the amount of vertical deflection of unsupported, overhanging end portion 18 by the provision of a center bearing 32 and the provision of means for applying a downward force to the ram 12 through the center bearing and between end support bearings 34 and 36 of the assembly 16. This downward force tends to make the ram "bow" downwards between its end support bearings 34,36 and thereby deflect at a slight angle at the end bearings themselves. It is this slight angularity of the ram 12 at its forward support bearing 34 which tends to lift the overhanging ram end portion 18, thereby reducing or eliminating the downward deflection due to gravity acting on the overhanging portion, as depicted in FIG. 2A. Thereby, the overhanging end portion 18 of the ram 12 is accurately supported and remains in perfectly centered alignment with the die package 25 throughout reciprocating movement of the ram.

Figure 3:
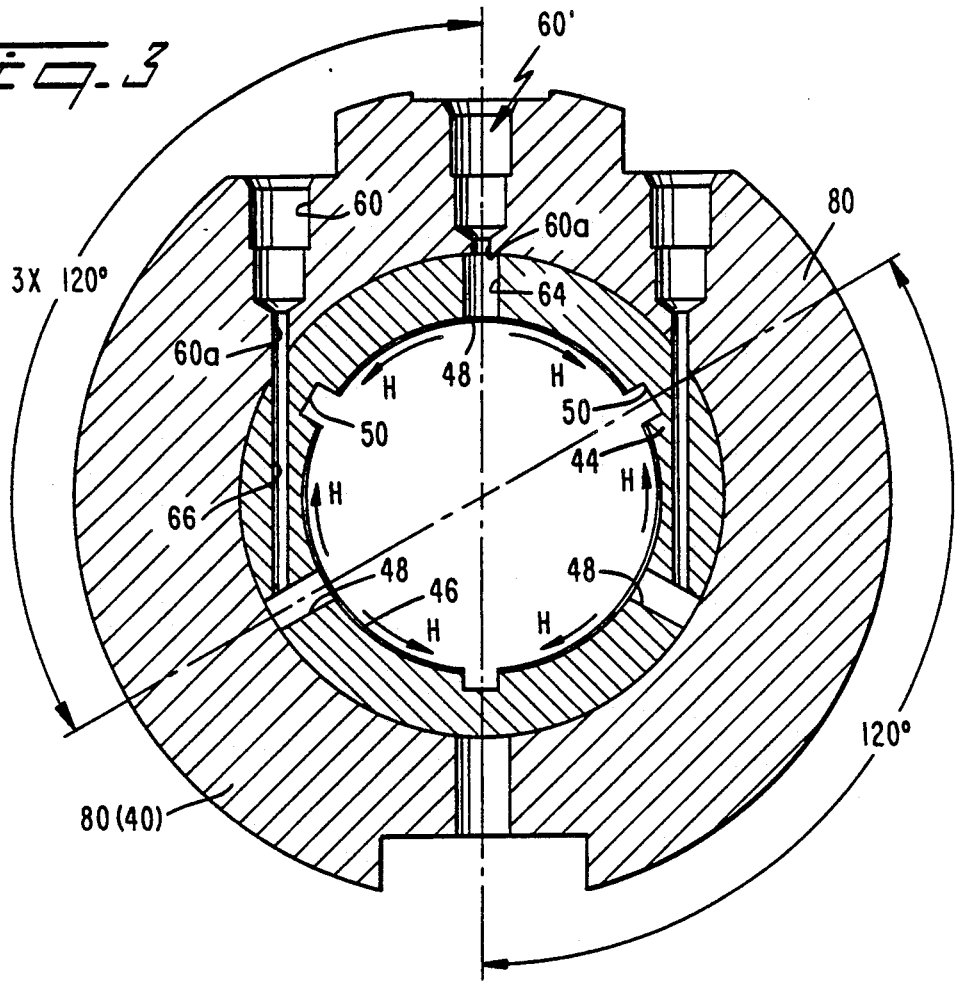
FIG. 3 is a sectional view taken along the line 2—2 of FIG. 2.
Figure 6:
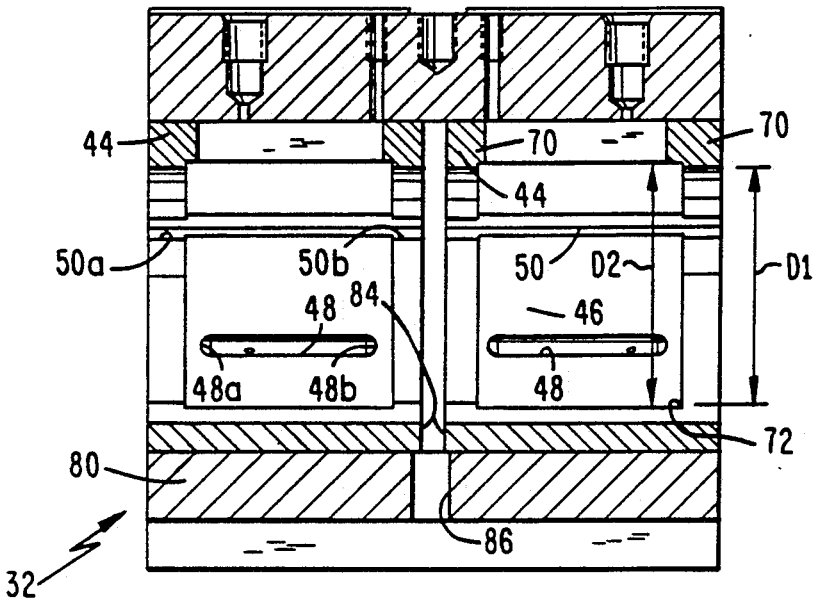
FIG. 6 is a sectional view taken along the line 6—6 of FIG. 6.

Hydrostatic bearing system 16 comprises a cylindrical bearing housing assembly 38 in which the identical front and rear bearings 34,36 are mounted at opposite ends thereof. Each end bearing 34,36 is provided with a cylindrical sleeve 40 securely clamped against the inner surface 42 of the housing 38 and a concentric bushing 44 within the sleeve 40 through which ram 12 is adapted to reciprocate in sliding contact with an oil film layer therebetween. With reference to FIGS. 3 and 6 (depicting the bushings in the center bearing 32 of which each individual bushing is identical to but shorter in length in relation to bushings 44), the inner cylindrical surface 46 of each bushing includes three circumferentially equispaced slots 48 extending longitudinally in the direction of movement of the ram 12 to define elongate hydrostatic pressure pads opposing the outer cylindrical surface 12*b* of the ram. Opposite ends 48*a*,48*b* of these slots 48 are closed and therefore spaced inwardly from corresponding ends of their associated bushing 44. The inner cylindrical surface 46 of each bushing 44 is further formed with three longitudinally extending drain slots 50 respectively disposed between the hydrostatic pressure pad slots 48. The drain slots 50 are adapted to receive a primary pressure oil flowing about ram 12 and circumferentially therein from the pressure pad slots 48 and are open at opposite ends 50*a*,50*b* thereof to the interior 52 of the housing 38 to enable the primary oil to be recirculated through a hydraulic exhaust adapter 54 mounted within an opening 56 formed in a bottom portion of the housing side wall 38.

The primary pressure oil is supplied to the hydrostatic pressure pad slots 48 by means of hydraulic supply devices 58 mounted within openings 59 formed in the upper portion of the housing 38. The lower end of each hydraulic supply device 58 is threaded to a tapped bore 60 formed in the bearing sleeve 40. The lower end of each hydraulic supply device 58 is also provided with a control orifice 62 for purposes described hereinafter. The bottom 60*a* of the center bore 60' extending through the remaining thickness of sleeve 40 opens directly into a short supply passageway 64 in the bearing bushing 44 in communication with the bottom of the upper hydrostatic pressure pad slot 48. The open bottoms 60*a* of the two remaining bores 60 (circumferentially equispaced from the top bore 60' and located in the same radial plane) are in respective communication with the bottoms of the two other pressure pad slots 48 through connecting supply passageways 66 formed in the bearing bushing 44.

The feature of providing symmetrically arranged hydrostatic pressure pad slots 48 respectively interposed between drain slots 50 extending the full length of the bushing 44 advantageously enables the ram 12 to remain centered under the action of the high pressure lubricating oil. More specifically, the high pressure oil is introduced into each hydraulic supply device 58 at approximately 1000 psi. The oil flows through the control orifice 62 of each device 58 which, when the ram is centered, applies a predetermined pressure drop (e.g., 500 psi) to the oil. The oil then enters each hydrostatic pressure pad slot 48 through the appropriate passageways (60*a*,64,66). The oil is constrained to flow circumferentially from the pressure pads 48 to the adjacent drain slots 50 in the directions indicated by arrows H,H'. As the oil flows circumferentially, the pressure drops to zero and this pressure distribution creates a force that lifts the ram 12. By using multiple pressure pad slots 48 in the manner described above, the ram 12 can thereby be centered.

It will be understood that the oil flows and pressures are ultimately determined by the clearance gap 68 between the ram 12 and the bushing 44. As the oil flows through the control orifices 62, the oil pressure drops as mentioned above. Initially, the pressure is maximum at the hydraulic supply devices 58 upstream from the control orifices 62. The pressure drop across the control orifice 62 is a function of oil flow and is designed so that, nominally, the pressure at the pads 48 (downstream from the control orifice) is about one-half of the supply pressure. As the oil flows circumferentially from the pads 48 to the drain slots 50 the pressure drops further and is always zero at the drain slots. In the initial case when the ram 12 is centered, the pressure at each of the pads 48 is equal so each applies a radial force against the ram, the vector sum of which forces is zero; therefore, the ram remains centered.

Should an external force such as the deflection force F described hereinafter tend to displace the ram 12 toward a given one of the pressure pad slots 48, the radial clearance between the ram and that pad becomes less, constricting the oil flow path which reduces the flow and the pressure drop across the associated control orifice 62. This reduced pressure drop across the control orifice 62 equates to a higher pad pressure at that particular pad 48. Conversely, at the other pads 48, the radial clearance between the ram 12 and pads has simultaneously increased, thereby reducing the constriction of the oil flow path thereat which in turn allows for greater flow and a greater pressure drop across those control orifices. This greater pressure drop reduces the pressure at these other pads. The net effect is that any tendency to radially displace the ram will be inherently opposed by centering vector forces which advantageously make the bearings 32,34,36 exceedingly rigid and stable.

The performance of the above-described hydrostatic support system is dependent largely upon a circumferential flow of oil from the pressure pad slots 48 to the drain slots 50 in the manner described above. If the oil is allowed to flow in the axial direction of the bearing 32,34,36 (i.e., in the longitudinal direction A parallel to the ram 12) rather than circumferentially H,H', the desired pressure distributions are no longer properly controlled under such axial flow conditions. In most hydrostatic systems utilizing rotating shafts, the problem of axial flow is not critical to proper bearing operation since, as the shaft rotates, the oil is frictionally moved by the shaft in a circumferential direction. However, when the shaft or ram 12 reciprocates without rotating, as in the case of ram 12 herein, the axial oil flow induced by the reciprocating ram degrades bearing performance. At high reciprocating speeds (such as in a can body maker to which the present invention preferably pertains), such reciprocation may cause substantially the entire oil flow to be axial instead of circumferential, possibly resulting in complete bearing failure.

In accordance with the present invention, to minimize axial oil flow, the opposite end portions 70 of each bushing 44 has a decreased bushing inner diameter D1 in relation to the intermediate larger inner diameter portion D2 of the bushing between the end portions (i.e., $D1<D2$). This decreased end portion diameter creates a step 72 which effectively functions as a dam to minimize axial oil flow out of the bearing to ensure better bearing support during reciprocating movement of the ram. The ratio D2/D1 of the original bushing diameter (defined as a land and being the intermediate portion of the bushing located between the stepped ends) and the decreased bearing diameter of the steps 72 determines the stiffness of the oil film to enable the bearings 32,34,36 to perform as hydrodynamic bearings while providing better hydrostatic performance. The optimum longitudinal length of the stepped ends 72 and land formed therebetween as well as the original and decreased bushing inner diameters may be determined by an engineer of ordinary skill from the foregoing discussion as well as the discussion of stepped film bearings in "Theory and Practice of Lubrication for Engineers" by Dudley D. Fuller, at pages 252–257, the disclosure of which is hereby incorporated by reference herein.

With the foregoing design, the ram end bearings 34,36 provide optimal support for reciprocating ram 12 at any velocity. When the axial velocity of the ram 12 is low, the combination of the hydrostatic pressure pad slots 48 and drain slots 50 advantageously serves to center the ram accurately and the hydrodynamic sections have virtually no adverse effect due to the presence of the stepped ends 72 of the bushing. When the ram velocity is high, the axial flow of oil through the bearing 32,34,36 disrupts hydrostatic performance (i.e., by creating axial oil flow instead of circumferential oil flow) to some extent. However, advantageously, this same axial flow creates a hydrodynamic step at 72 that provides a centering force maintaining the ram 12 in its centered position until the ram velocity drops and the hydrostatic sections again become effective.

Figure 2:
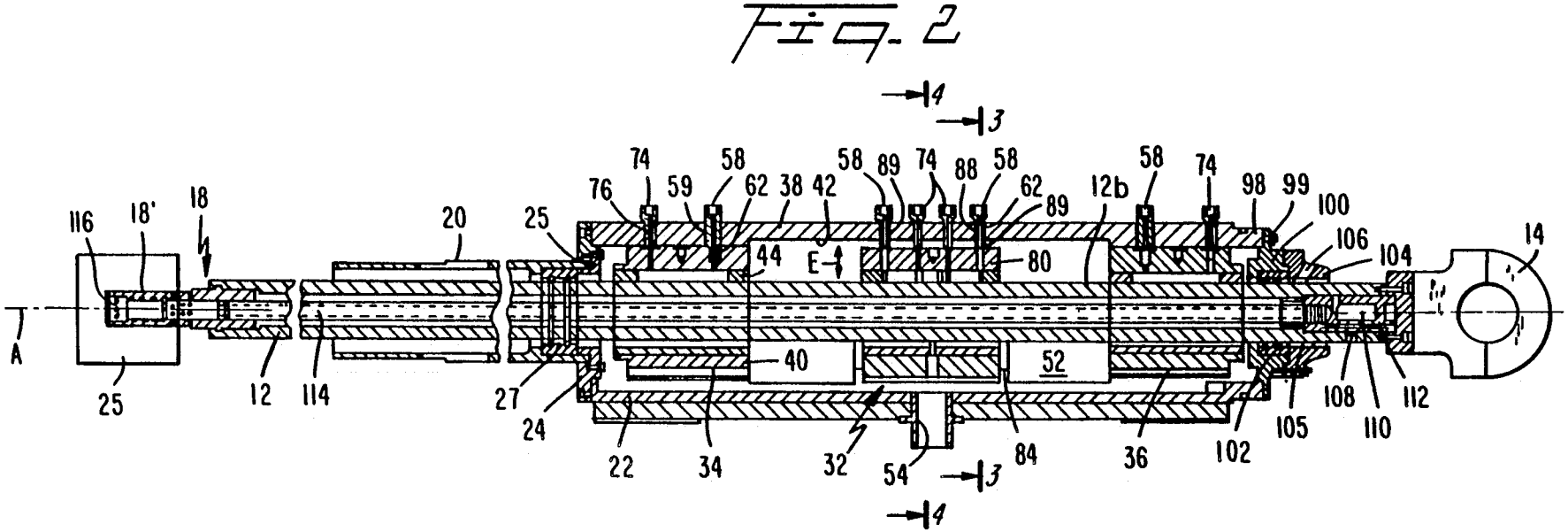
FIG. 2 is a sectional view of the ram mechanism and a hydrostatic bearing support assembly therefor.
Figure 2A:
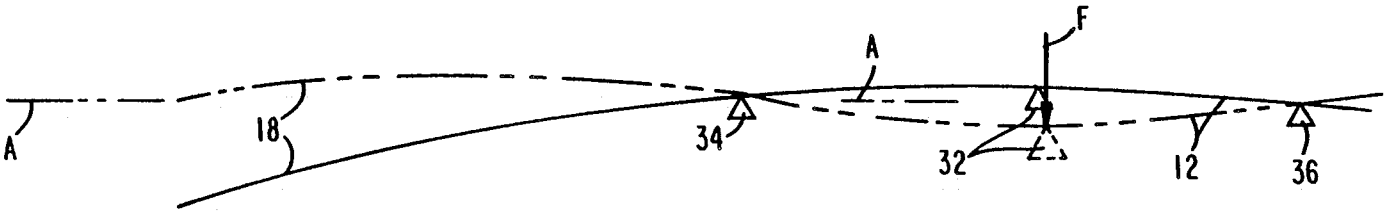
FIG. 2A is a free body diagram depicting the shape of the ram in loaded and unloaded conditions.

As best depicted in FIG. 2, each end bearing 34,36 is preferably also provided with three pressure monitoring devices (e.g., pressure switches) 74 mounted in bores 76 formed in the upper portion of the bearing housing assembly 38 in respective communication with one of the hydrostatic pressure pad slots 48 through connecting passageways (not shown but identical to 60*a*,64,66 and longitudinally spaced therefrom) formed in the bearing sleeve 40 and bushing 44 in the same radial plane as the transducers. The monitoring devices 74 are utilized to ensure proper bearing performance by monitoring the pressure at each hydrostatic pressure pad slot 48 during reciprocating movement of the ram 12.

To minimize vertical deflection of the unsupported, overhanging end portion 18 of ram 12, the center or intermediate bearing 32 comprises a generally cylindrical bearing sleeve 80 having a longitudinally extending channel 82 along its lower surface forming a drain cavity. The bearing sleeve 80 is retained in axially stationary position by projection 84 machined in the bearing having inner surface in contact with opposite end faces of the sleeve. The bearing sleeve 80 contains a pair of identical bushings 44 each formed with stepped ends 72 analogous to the stepped ends of the bushings in the end bearings 34,36 described supra. Each bushing 44 of the center bearing 32 is also formed with three circumferentially spaced hydrostatic pressure pad slots 48 and three drain slots 50 in a manner identical to the drain/pressure pad slot configuration of the bushings 44 in the end bearings 34,36 as described supra. The opposing inner end faces 84 of the center bearing bushings 44 are spaced from each other to provide a clearance enabling the drain slots 50 to drain oil from the bearings 32,34,36 into a vertical passageway 86 formed in the bearing sleeve 80 in alignment with the exhaust oil adapter 54. Two sets of three hydraulic supply devices 58 are provided to supply high pressure oil to each of the three hydrostatic pressure pad slots 48 of each center bearing bushing 44. Each hydraulic supply device 58 is slidably mounted within openings 88 formed in an upper portion of the bearing housing wall 38 with sliding sealing contact between the supply device and its associated opening achieved with a pair of O-rings 89. The lower end of each hydraulic supply device is in threaded contact with tapped bore 60 formed in an upper portion of the bearing sleeve 80 and flow passageways **60*a*,64,66 in the bearing sleeve and bushings 44 communicate the open bottom of each bore with its respective hydrostatic pressure pad slot 48 as depicted in FIG. 3**.

The center bearing 32 is maintained in a stationary axial location within the housing by means of a pair of machine ledges 84 projecting upwardly from an inner surface in the bottom portion of the housing wall in abutment with the end faces of the bearing sleeve as mentioned above. Otherwise, the center bearing 32 is located within the housing 38 in a floating state in the vertical radial direction indicated with arrow E by virtue of an appropriate clearance provided between the outer surface of the bearing sleeve 80 and the inner surface 42 of the bearing housing wall.

Figure 4:
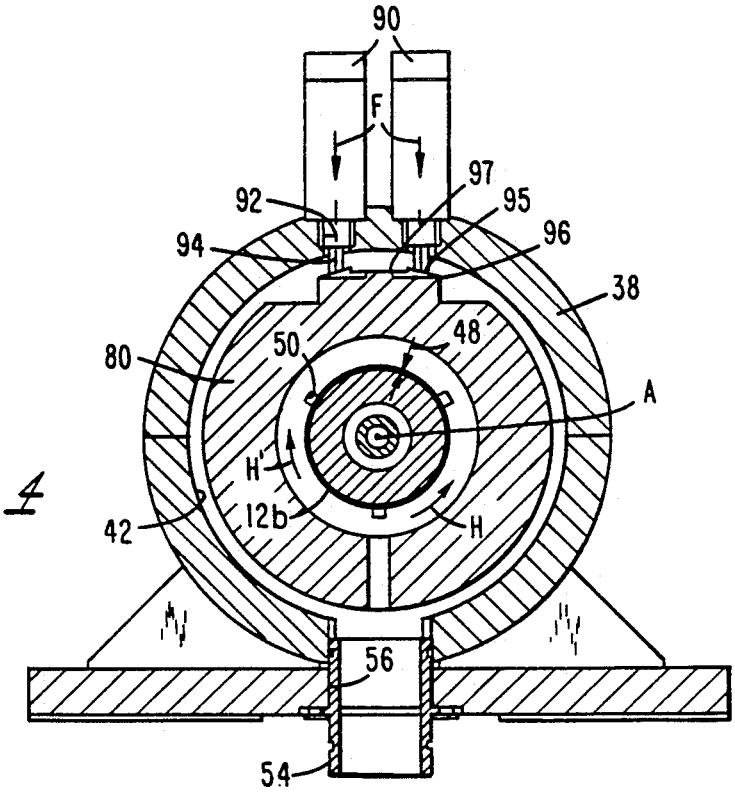
FIG. 4 is a sectional view taken along the line 4—4 of FIG. 2.
Figure 5:
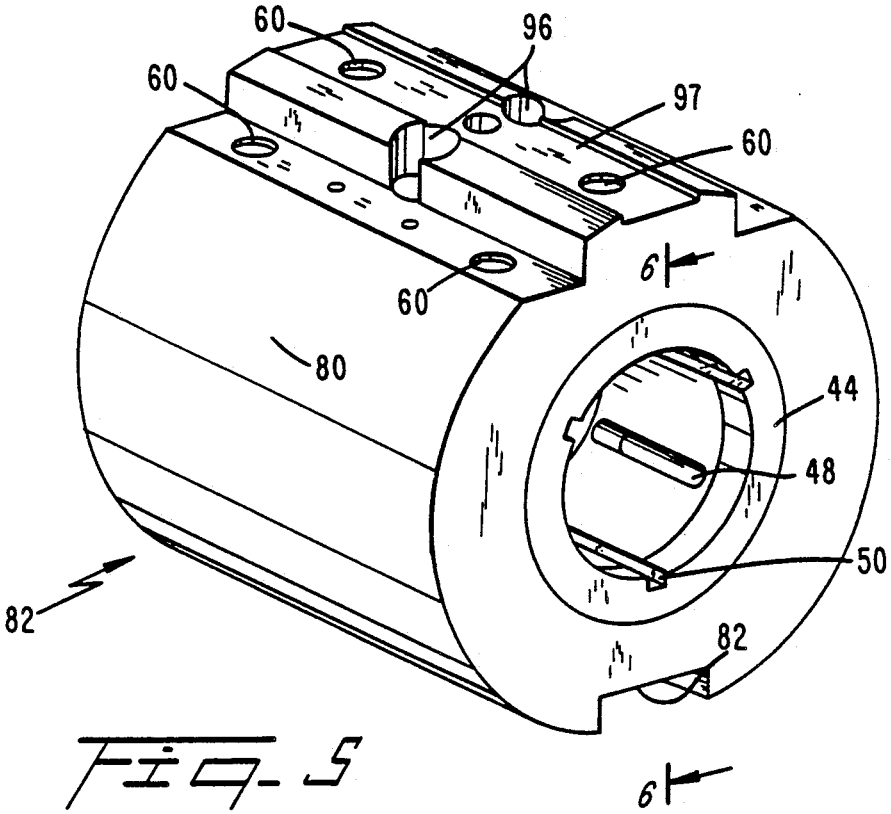
FIG. 5 is a perspective view of a center ram bearing.

In accordance with the present invention, with reference to FIGS. 4 and 5, a pair of air cylinders 90 are threadedly mounted in throughbores 92 formed in an upper portion of the bearing housing wall 38. Each air cylinder 90 includes a piston rod 94 extending downwardly through the mounting opening with its lower end 95 in abutting contact with cylindrical blind holes 96 formed in an upper surface 97 of the bearing sleeve 80. In accordance with the present invention, the air cylinders 90 are actuated to extend the piston rods 94 and produce a force or load F against the upper surface 97 of the bearing sleeve 80 which is transmitted to the reciprocating ram 12 through the bushings 44 so as to force the ram to "bow" downward between the end support bearings 34,36 to create an upward deflection of the ram within the end bearings that tends to lift the overhanging end portion 18 of the ram, for substantially coaxial alignment with axis A, as depicted in phantom line in the free body diagram of FIG. 2A wherein the solid line depicts ram 12 and overhanging portion 18 prior to application of force F and the phantom line depicts ram 12 and its overhanging portion under load F. The extent of "bowing" is somewhat exaggerated for purposes of illustration.

As will now occur to one of ordinary skill in the art, the air cylinders 90 may be operated to impart an intermediate, variable downward force F against the ram 12 through the center bearing 32 as a function of the increasing length of the overhanging end portion 18 during the extension stroke of the ram. Thereby, the air cylinders may be loaded in a continuously variable manner during the extension as well as the retraction strokes. In the alternative, a constant invariable force F calculated for a given set of load conditions may be imparted to the center bearing 32 in the manner described above.

From the foregoing disclosure, it will now be further obvious to one of ordinary skill that for a given overhang, the intermediate force can be selected to produce a desired deflection either in the upward or downward direction, or zero deflection. As mentioned briefly above, for a varying amount of overhang, such as in reciprocating ram 12 during its extension and retraction strokes, the intermediate force can be varied either in a predetermined manner or through automatic control so that the deflection of the end 18 of the ram is uniformly zero throughout its travel. The feature of reducing ram deflection at the working end 18 advantageously enables the working end to remain perfectly centered on drive axis A with the die package 25 to ensure that the metallic cans C are formed from blanks C′ in a high speed, reliable manner.

The rear or back end 98 of housing 38 is sealed with a rear seal pack housing 100 bolted at 99 to the rear end face of the housing. The non-working end of ram 12 extends through this seal pack housing through a wiper retainer ram seal 102 mounted within the seal pack. An air distribution manifold 104 is bolted to the rear end face of the seal pack housing 100 and a pressurized air line (not shown) is adapted to be connected to the manifold at inlet opening 106. Pressurized air entering inlet opening 106 is admitted into a series of circumferential slots 105 formed in the inner surface of the manifold in opposition to the outer surface of the ram and is prevented from entering the bearing housing via the wiper seal mechanism 102. As the ram moves forwardly into its front dead center position depicted in FIG. 1D, the circumferential slots 105 within manifold 104 communicate with radial holes 108 extending through the ram into a hollow center region thereof in the rear non-working end. When in axial registry, pressurized air from the manifold is supplied through circumferential slot 105 and radial holes 108 into a check valve 110 where the pressurized air flow is directed into plural axially extending passages 112 formed downstream from the check valve in the center region of the ram and into an air tube 114 extending through the ram into the punch 18′ in the working end 18. The punch is provided with a series of holes 116 through which the pressurized air exits to blow the can off of the punch whereupon the star wheels are rotated to index the formed can C to the next working station. The check valve 110 maintains air pressure within the air tube 114 until the ram retracts from die package 25. More specifically, the check valve 110 is oriented so that its inertial forces will ensure that it remains shut until approximately mid-way through the return stroke, well after the can C has been blown off the punch 18′.

With the blow off system described immediately above, flexible hoses and rotary unions are advantageously not required. The length of the air passages are minimized to thereby decrease air consumption. The check valve 110 uses inertial forces to maintain its seal on the air passages as described above.

Ram Mechanical Crank Drive Assembly

As mentioned above, a crank drive assembly 120 reciprocates the sliding ram 12 at high speed in a straight line along central longitudinal axis A. When connected to the sliding ram 12, it is important that crank drive assembly 120 does not produce any internal bending loads on the ram 12, or any other loads normal to the output path A of the sliding ram.

To achieve reciprocating, horizontal straight line motion of ram 12, crank drive assembly 120 utilizes a gearing arrangement 121, which is patterned after a cardan type gearing arrangement in the modified unique manner set forth below, for converting rotation of an input drive shaft 122 into straight line reciprocating motion of an output shaft 124 formed at opposite ends of the crank drive assembly.

The cardan gearing arrangement 121 comprises a primary crank shaft 126 rotatably mounted through front and rear, outboard and inboard primary crank shaft roller element bearings 128 and 130 within a stationary crank shaft housing 132. In the preferred embodiment, the primary crank shaft 126 is of two-part rigid construction for reasons which will become apparent hereinbelow, the rear or input drive part **126*a* being seated in rear bearing 130 within a centered, cylindrical input shaft drive housing 134 secured to project axially rearwardly from the back wall 136 of the crank shaft housing 132; the remaining front or crank output part 126*b* attached to project forwardly from the rear part 126*a* through the crank shaft housing 132 with the forward end of the front part fitted in the outboard or main primary crank shaft bearing 128. The front and rear primary crank shaft parts 126*a*,126*b* rotate as one shaft about their central longitudinal drive axis L1 which is coaxially aligned with the primary crank shaft bearings 128,130. An end of the rear part projecting rearwardly from the input shaft housing 134 defines the input drive shaft 122 connected by a clutch unit 355 to flywheel 350 and to a belt 401** driven by a motor drive unit M about axis L1.

The front part **126*b* of the primary crank shaft 126 is formed with a longitudinally extending cylindrical cavity 140 having an eccentric, central longitudinal axis L2 parallel to and radially offset from axis L1. The cavity 140 eccentrically mounts a secondary crank shaft 142 within the primary crank shaft 126*b*, opens to the front face 146 of the front part 126*b*, and extends to a rear portion of the primary crank shaft front part, with its bottom wall 148 adjacent the primary crank shaft rear part 126*a*. Portions of the primary crank shaft 126*b* defining the cavity 140 and extending transversely or radially towards axis L1 effectively constitutes a crank arm or primary throw of integral construction with the primary crank shaft. The secondary crank shaft 142 is rotatably mounted at its inboard, smaller diameter end 150 within the bottom 152 of the eccentric cavity 140 with a rear or inboard secondary crank shaft roller element bearing 154 received in the cavity bottom. The secondary crank shaft 142 extends longitudinally forwardly within the eccentric cavity 140 and has its large diameter forward portion 156 rotatably mounted within a cylindrical forward portion 158 of the cavity formed in the forward portion of the primary crank shaft 126*b*. An outboard or front, secondary crank shaft roller element 160 bearing fitted within the cylindrical side wall 162 defining the forward part 158 of the cavity, and the inboard or rear secondary crank shaft bearing 154, rotatably support the secondary crank shaft 142 for rotation about its longitudinal axis L2 within the primary crank shaft 126. The outboard secondary crank shaft bearing 160 is advantageously coplanar and radially inwardly spaced from the outboard primary crank shaft main bearing 128 to reduce bearing loads during rotation of the primary crank shaft 126** about axis L1.

The secondary crank shaft 142 is therefore mounted eccentrically in relation to the rotational axis L1 inside the primary crank shaft 126, and revolves around the primary crank shaft drive axis L1 during rotation of the primary crank shaft induced by motor drive unit M while being rotated about its axis L2 through a planetary gear train. The planetary gear train comprises a stationary ring gear 170 mounted within the crank housing 132, between the secondary crank shaft bearings 154,160, through a cylindrical gear retainer 172 bolted to the inner surface of the housing at a stepped bearing portion 174 thereof. A pinion 176 is mounted to an intermediate portion 178 of the secondary crank shaft 142, between the secondary bearings 154,160, for co-rotation with the secondary crank shaft about eccentric axis L2. The pinion teeth project outwardly from an opening 180 in the side wall 182 of the primary crank shaft front part **126*b* defining the secondary crank shaft mounting cavity 140 and formed between the secondary crank shaft bearings 154,160 to mesh with the inner teeth 184 of the ring gear 170 encircling the primary crank shaft 126*b*. The front end 186 of the secondary crank shaft 142, which is located forwardly of the primary crank shaft 126*b* and eccentrically with respect to the remaining portion of the secondary crank shaft within the primary crank shaft, defines the output shaft 124 of the crank drive assembly 120** which is constrained to reciprocate in horizontal straight line movement (axis A) under the combined motions of the primary crank shaft, the secondary crank shaft and the action of the pinion gear meshing with the ring gear.

More specifically, rotation of the primary crank shaft 126 at machine speed about the rotational axis L1 by motor drive unit M causes the pinion 176 to roll along the inner periphery of the ring gear 170, in meshing contact with the inner teeth 184, causing the pinion and the secondary crank shaft 142 to rotate at twice machine speed about axis L2 in a rotational direction opposite the rotational direction of the primary crank shaft 126, while revolving about axis L1. Thereby, if the pitch diameter of the pinion 176 and the pitch diameter of the inner teeth 184 of the ring gear 170 are in the ratio of 1:2, in accordance with principles governing cardan gearing as in the present invention, and if the output axis L3 of the eccentric output shaft 124 of the secondary crank shaft 142 lies on the pitch circle of the pinion gear as in the present invention, then the resulting motion of the output axis L3 will be in a straight line along ram axis A.

A number of novel advantages occur by locating the front or outboard primary crank shaft bearing 128 in close proximity adjacent the straight line travel path A of the output shaft 124 and thereby the sliding ram 12. One such advantage is the minimization of any cantilevering effects that would otherwise occur by locating the outboard primary crank shaft bearing 128 axially towards the input shaft 122 as in conventional cardan gearing. In other words, by locating the outboard primary crank shaft bearing 128 as close as possible to the plane of straight line movement A of the sliding ram 12, virtually no internal bending loads are transmitted to the output shaft 124 that would otherwise adversely act on the sliding ram 12, causing the ram to deflect from its straight line motion in a horizontal plane.

Another advantage achieved by locating the outboard primary crank shaft bearing 128 as close as possible to the straight line of travel of the output shaft 124 and sliding ram 12 is the ability to support both secondary crank shaft bearings 154,160 as well as the secondary crank shaft 142 and pinion 176 within the primary crank shaft bearings 128,130. In other words, virtually all moving mechanical parts (except the eccentric output shaft 124) in crank drive 120 are subject to only rotational movement, not reciprocating movement, reducing the amount of input energy that must be dissipated each time a reciprocating part reverses its direction at each end of the stroke. Since the input energy imparted to the reciprocating parts is dissipated through the flywheel, the flywheel size is advantageously minimized. Furthermore, by locating the outboard primary crank shaft bearing 128 as close as possible to the straight line of motion A of the ram 12, thereby virtually eliminating overhanging loads between the outboard bearing 128 and the output shaft 124, internal bending loads that would otherwise particularly act on this bearing, and the other bearings to a lesser extent, are minimized, avoiding bearing fatigue and failure. The aforesaid bearing placements also advantageously result in a gearing mechanism 121 which is very stiff under load and therefore minimizes distortion of the internal pieces (e.g., the primary and secondary crank shafts) caused by bending loads, thereby avoiding deviation in the straight line motion of the output shaft and sliding ram.

The inner pitch diameter of the stationary ring gear 170 defines the length of stroke of the output shaft 124 and the sliding ram 12. The inner diameter of the outboard primary crank shaft bearing 128 is larger than the stroke length, enabling placement of the outboard bearing as close as possible to the path of straight line motion so as to increase the working stroke length of the ram 12 and enable fabrication of larger length cans C than heretofore possible.

As mentioned above, the primary crank shaft 126 is of two-part construction with the rear part **126*a* perfectly centered on drive axis L1 and projecting rearwardly from its centered, cylindrical rear housing 134 attached to the back wall 136 of the crank shaft housing 132 to define the input shaft 122. The rear housing 134 includes a cylindrical side wall 190 having a forward end 192 interfitting within a cylindrical opening 194 of the crank shaft housing back wall 136. An annular mounting flange 196 projects radially from an outer surface of the side wall 190, spaced from the forward end by the thickness of the back wall 136, for securely mounting the rear housing to the back wall with bolts 198. The interior forward portion 200 of the housing side wall 190 has a large inner diameter in which the largest diameter forward portion 202 of the primary crank shaft rear part 126*a* is received and spaced from the housing inner side wall with a clearance bushing 204. The rearwardly extending portion of the input shaft housing 134 has an inner diameter less than the large inner diameter of the forward portion 202 to define a step 206 against which the rear face of the clearance bushing 204 abuts for stationary axial retention around the large diameter forward portion 202 of the primary crank shaft rear part 126*a*. The inboard or rear primary crank shaft roller bearing element 130 is disposed between this smaller diameter portion of the input shaft housing 134 and a first smaller diameter portion 210 of the primary crank shaft rear part, formed rearwardly around the larger diameter forward portion 212, and retained in position with a lock washer 214 and retainer nut 216. An annular end plate 218 bolted to the rear face of the housing 134 seals the rear portion of the housing with an O-ring 220 between the end plate and housing and a seal ring 222 extending between the central opening of the end plate and the second smaller diameter portion 224 of the primary crank shaft rear part 126*a* projecting rearwardly through the opening. The front edge of the seal ring 222 abuts against a rear facing annular step 226 formed between the first and second smaller diameter portions 210,224 and is retained within the opening thereby. The input shaft of a diameter less than the diameter of second portion 224 projects rearwardly from the housing 134** for connection to the clutch brake unit, flywheel, belt and motor drive as described more below.

The clearance bushing 204 and inboard primary crank shaft bearing 130 perfectly centers the primary crank shaft rear part **126*a* on the drive axis L1. The front face 228 of the rear part 126*a*, which projects slightly forward from the crank shaft housing back wall 136 into the crank shaft housing 132, is formed with a circular recess 230, centered on axis L1, receiving a pilot portion 232 of corresponding diameter extending rearwardly from a rear face of the primary crank shaft front part 126*a* disposed in the crank shaft housing 132. The pilot portion 232 is shrink fitted into the circular recess 230 and the front and rear primary crank shaft parts 126*a*,126*b* are bolted together (not shown) to form the rigidly rotating primary crank shaft 126 of integral construction. By this arrangement, the primary crank shaft front part 126*b*, which is of larger diameter than the rear part 126*a* and houses the secondary crank shaft 142 and secondary crank shaft inboard and outboard bearings in the eccentric cavity 140** defining the secondary crank shaft eccentric drive axis L2 in the unique manner described above, may advantageously be formed of a lighter material (such as aluminum) than the rear part (e.g., steel) to thereby reduce the moment of inertia of the rotating parts and lessen bearing fatigue.

The secondary crank shaft 142 is advantageously hollow to both reduce the moment of inertia of the rotating parts and define a pressurized oil chamber 232 within the secondary crank shaft for reasons described more fully below. The rear end or smallest diameter portion 150 of the secondary crank shaft 142 is mounted within the inboard secondary crank shaft bearing 154 in the bottom of the cylindrical cavity 152 with a lock washer 230 and retainer nut 232 securing the bearing against the smallest diameter end portion 150 and a step 234 thereof formed adjacent the intermediate diameter portion 178 of the secondary crank shaft 142. The intermediate diameter portion 178 is elevationally coextensive with the lateral cavity opening 180 and the pinion gear 176 is mounted to the intermediate diameter portion for meshing contact with the stationary ring gear 170 as described supra. The rear end face 236 of the secondary crank shaft 142 includes a cylindrical recessed opening 238 centered on axis L2 which receives a clearance bushing 240 having a rearwardly extending smaller diameter end received in a cylindrical recess formed in the bottom wall 148 of the cavity 140 for purposes described hereinafter.

The cylindrical forward portion of the cavity 140, as mentioned above, contains the outboard secondary crank shaft bearing 160 for rotatably supporting the largest diameter portion 156 (centered on axis L2) thereof within the forward portion of the cavity. A bearing lock washer 242 and retainer nut 244 contacting a rearward end of the outboard bearing 160 and a retainer ring 246 contacting the forward end of the bearing and bolted to the front face 146 of the primary crank shaft **126*b* are used to axially retain the outboard secondary crank shaft bearing within the cavity 140. The outboard, large diameter primary crank shaft bearing 128 encircling the forwardmost longitudinally extending sides of the primary crank shaft 126*b* is coplanar with the outboard secondary crank shaft bearing 160 and retained in position with an annular spacer element 248 bolted to the front face of the crank shaft housing 132 and an annular retainer 250 bolted to the front face of the spacer in abutment with the bearing outer sleeve. The inner sleeve of the outboard primary crank shaft bearing abuts against an annular mounting flange 252** projecting radially from the outer surface of the primary crank shaft for secure axial retention.

As mentioned above, the forwardmost 186 end of the secondary crank shaft 142 projecting forwardly from the primary crank shaft **126*b* includes a transversely extending second throw or crank arm 254 integrally formed with the front end of the large diameter portion 156 of the secondary crank shaft and eccentrically offset output shaft portion 124 integrally formed with the eccentric distal end of the second crank arm. The longitudinally extending output shaft 124 is cylindrical and adapted for straight line movement in accordance with the principles set forth above. The output shaft axis L3 is offset from the secondary crank shaft axis L2 by a radial distance corresponding to the radius of the pitch diameter of the pinion gear 176 and thereby one-half the radius of the stationary ring gear 170. Thus, the output shaft axis L3 reciprocates in a straight line (along axis A) during the aforesaid operation by a distance equal to the diameter of the stationary ring gear 170**.

The short cylindrical output shaft 124 rotates about its longitudinal axis L3 (parallel to axes L1,L2) as the shaft moves in horizontal straight line motion (in a plane perpendicular to axis L3) in accordance with principles of cardan gearing operation. To interconnect the output shaft 124 to the input (non-working) end 14 of the reciprocating ram 12 and the clevis 14 thereof, the cylindrical end 260 of a connecting link 262 is rotatably mounted to the outer annular surface of the output shaft 124 with a roller element bearing 264. The rear end of the bearing 264 abuts against a shoulder 266 formed in the outer surface of the output shaft 124 and is retained on the shaft by means of an end cap 266 bolted to the shaft.

The output shaft 124 is hollow and communicates with the hollow region 232 of the secondary crank shaft 142 through a drilled passageway 268 which supplies oil to the hollow cavity 270 of the output shaft from the hollow region in the second crank shaft. The end cap 266 closing off the front end of the output shaft cavity 270 is formed with a rotary union 274 and retainer 276 enabling a flexible line 278 to be connected to the output shaft 124 for supplying pressurized lubricating oil to a clearance bushing 280 formed between the clevis 14 and link pin 282 of the reciprocating ram 12.

In accordance with another unique feature of the present invention, a pair of balancing counter-weights 284 and 286 are respectively secured to the front face 146 of the primary crank shaft **126*b* and the crank portion 254 of the secondary crank shaft 142 extending transversely and forward of the primary crank shaft so as to eliminate any external inertial forces as well as any overhanging loads created by the mass of the eccentric secondary crank portion (254,124) during operation of the drive unit M. With reference to FIGS. 9A–9E, the primary crank shaft counter-weight 284 is of truncated sector shape defined by an outer circumferential edge 284*a* coextensive with the circumference of the primary crank shaft housing 132 and an inner circumferential edge 284*b* bolted at 285 to the front face 146 of the primary crank shaft 126*b* diametrically opposed to the second crank shaft 142. The secondary crank shaft counter-weight 286 is also of truncated sector shape and is formed with an outer circumferential edge 286*a* having the same radius of curvature as the inner circumferential edge 284*b* of the primary crank shaft counter-weight 284 and an inner circumferential edge 286*b* bolted at 287 to the front face of the second crank arm 254 of the secondary crank shaft 142**.

The primary and secondary crank shaft counter-weights 284,286 are coplanar and the mass and centroid of the primary crank shaft counter-weight are chosen (in a manner known to one of ordinary skill in the art based upon a review of this specification) so that when reciprocating ram 12 is attached to the output shaft 124 of the secondary crank shaft 142, all horizontal imbalancing forces are cancelled. Likewise, the secondary crank shaft counter-weight 286 and the mass and centroid thereof are chosen to remove all vertical imbalancing forces during operation of the crank drive unit 120. To balance the mechanism, the centroid of the secondary crank shaft counter-weight 286 must be one-fourth of the mechanism stroke away from the center line axis L2 of the secondary crank shaft 142 and the mass of the secondary crank shaft counter-weight must equal the mass of the reciprocating ram 12.

FIGS. 9A–9E are illustrations of the relative positions of the primary and secondary crank shaft counter-weights as well as the output shaft at primary crank shaft angles of 0°, 45°, 90°, 180° and 270°, respectively.

Figure 7:
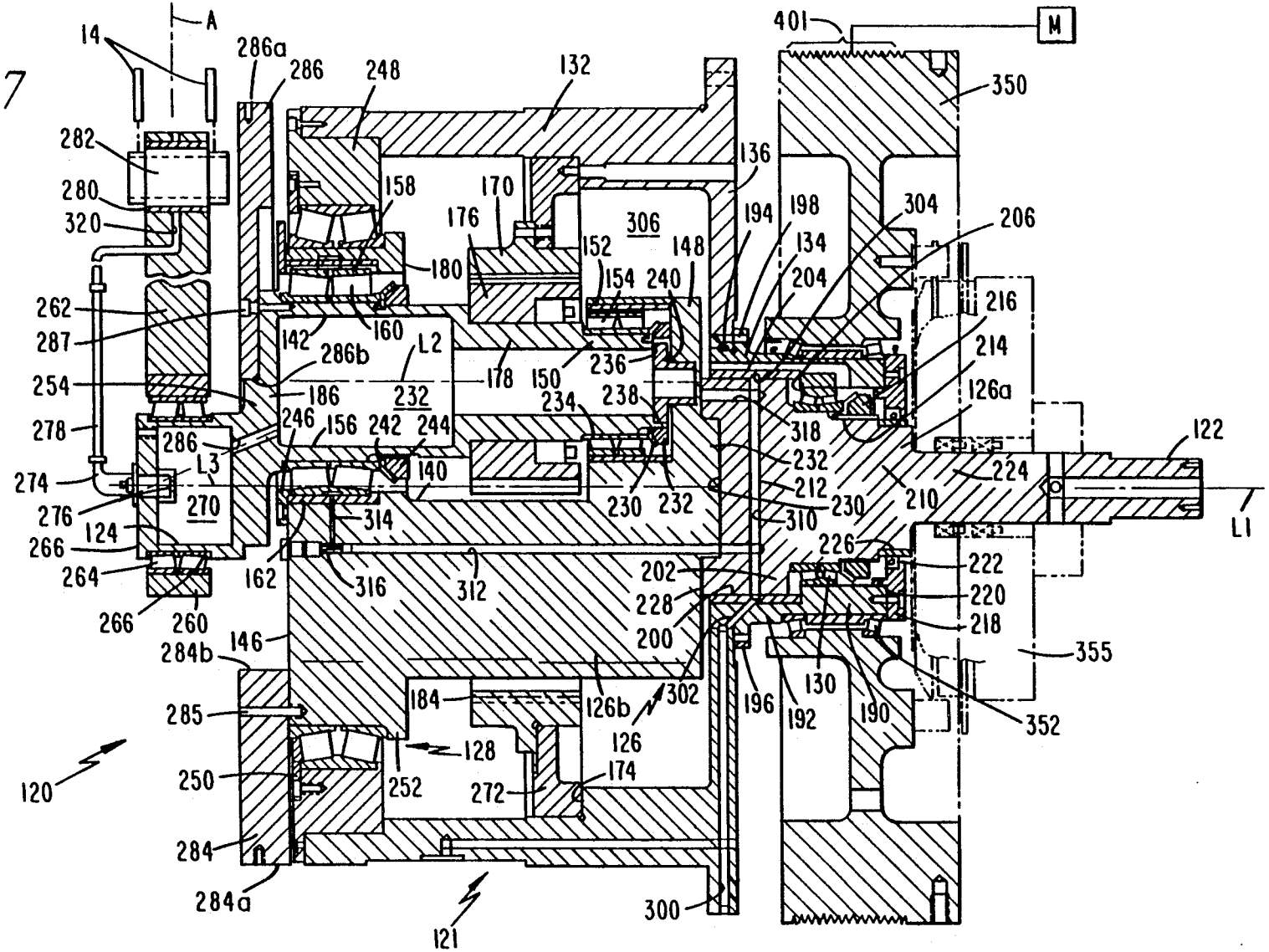
FIG. 7 is a horizontal sectional view of the crank drive mechanism taken through a horizontal central plane thereof.
Figure 8A:
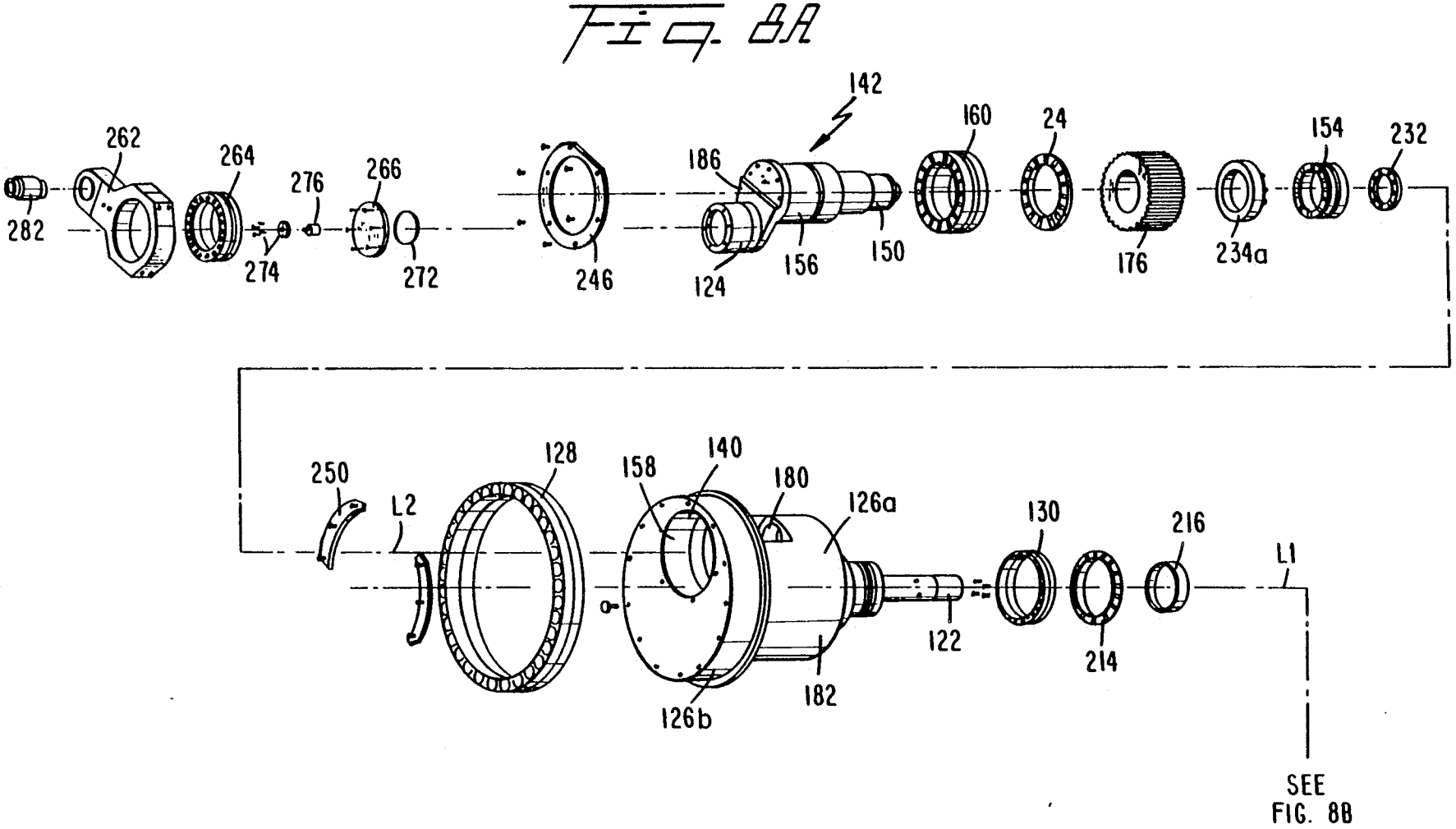
FIGS. 8A and 8B are exploded perspective views of the crank drive mechanism and hydrostatic bearing support assembly therefor.
Figure 8B:
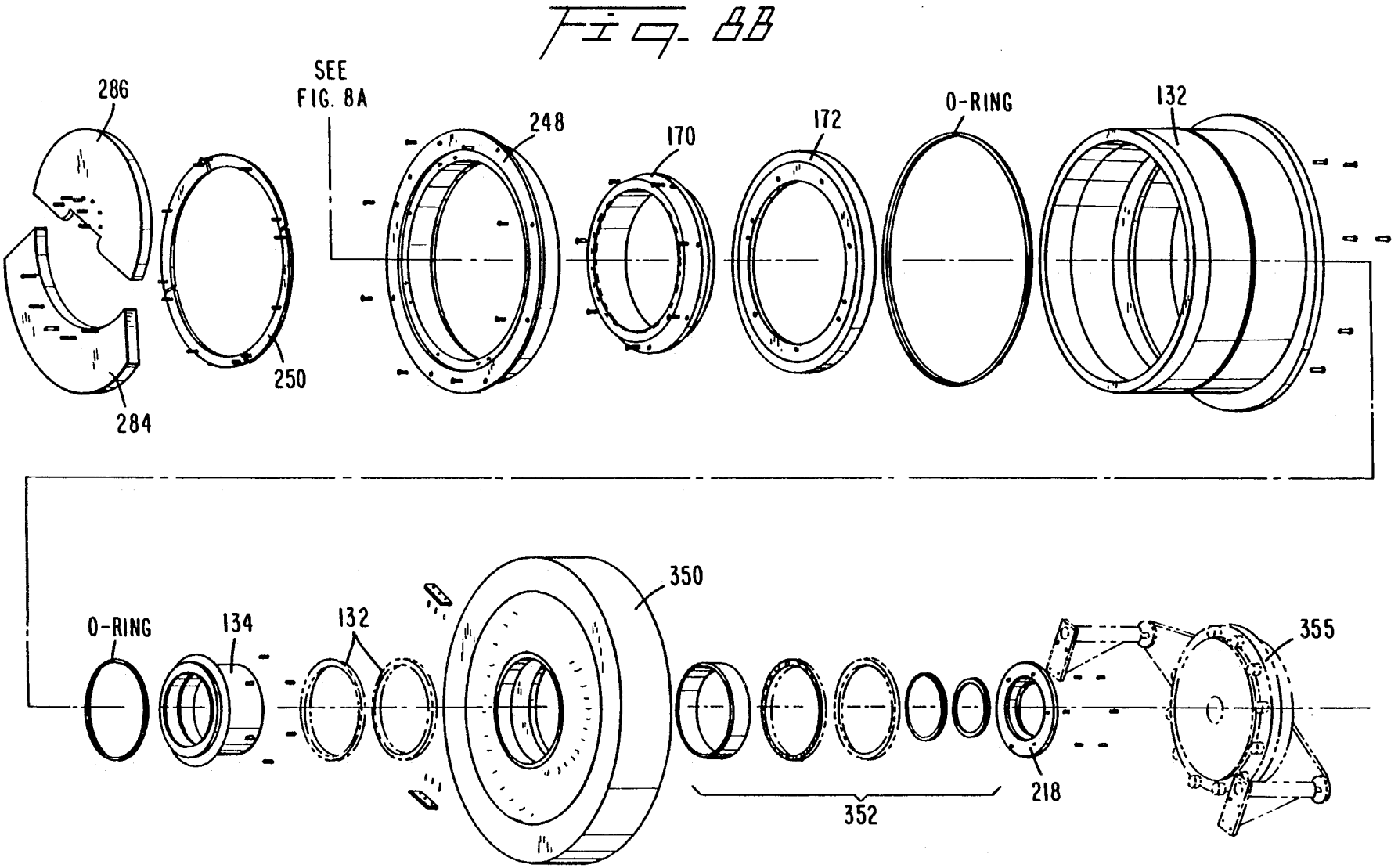
Figures 9A, 9B, 9C, 9D, 9E:
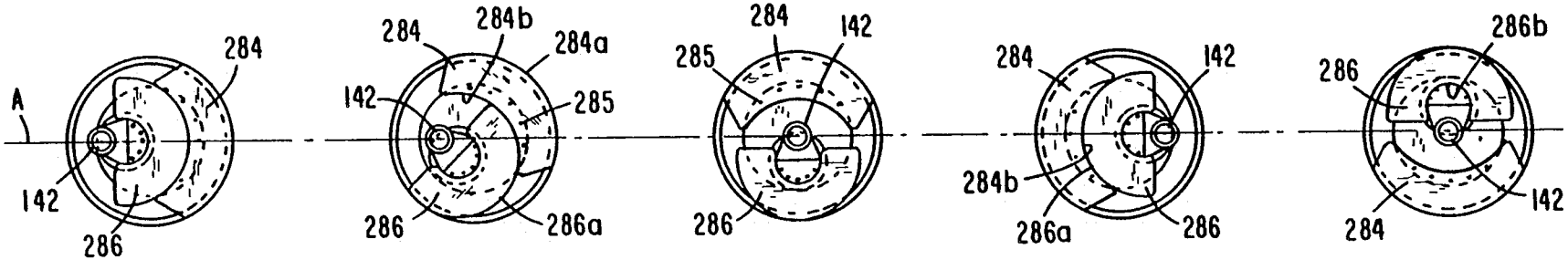
FIGS. 9A–9E are front end views of the crank drive mechanism depicting the relative positioning of the primary and secondary crank shaft balancing counter-weights at various degrees of rotation of the primary crank shaft.

A unique system for lubricating all rotating parts within the crank shaft housing 132 as well as the input shaft rear housing 134 containing the input shaft 122 of the primary crank shaft **126*a* is also disclosed. With reference to FIG. 7, pressurized oil is supplied through an oil supply drilled passageway 300 extending radially through the back wall 136 of the crank shaft housing 132 to intersect the front end portion 192 of the rear cylindrical side wall of the input shaft housing 134. This oil supply passageway 300 supplies pressurized oil through a cross drilled passageway 302 formed in the cylindrical side wall of the input shaft housing to an annular groove 304 formed in the inner surface of the clearance bushing 204 encircling the forward large diameter portion 212 of the primary crank shaft rear part 126*a*. The clearance bushing 204 is designed to allow lubricating oil to leak between the inner surface of the clearance bushing and the outer surface of the primary crank shaft rear part 126*a* in both forward and rearward directions. Oil leaking in the rearward direction enters the space containing the inboard primary crank shaft bearing 130 to lubricate same while oil leaking forwardly of the clearance bushing enters a sump 306 formed between the crank shaft housing 132 and the primary crank shaft 126*b* to supply lubricating oil to the stationary ring gear teeth 184 as well as the pinion gear teeth 176 and the large diameter outboard primary crank shaft bearing 128**.

The oil supplied through the clearance bushing 204 to the inboard primary crank shaft bearing 130 is returned to the sump 306 within the crank shaft housing 132 through a drilled passageway 308 formed in the cylindrical side wall of the input shaft housing 134. Thereby, any lubricating oil intentionally leaked to the inboard primary crank shaft bearing 130 through the clearance bushing 204 is returned to the sump 306 of the crank shaft housing 132 to avoid over-pressurization.

The large diameter portion 212 in the rear part 126*a* of the primary crank shaft 126 is formed with a transversely extending oil passageway 310 opening at opposite ends thereof to the annular groove 304 in the clearance bushing. Thereby, this cross drilled passageway 310 is constantly supplied with pressurized oil from annular groove 304. A longitudinally extending oil supply passageway 312 is formed to extend the entire length of the primary crank shaft front part 126*b* as well as through a portion of the primary crank shaft rear part 126*a* to intersect the cross drilled passageway 310 therein. This longitudinally extending passageway 312 is formed on the opposite side of drive axis L1 in relation to the secondary crank shaft 142 and includes a small cross drilled passageway 314 at its forward end portion which intersects the outboard secondary crank shaft bearing 160 to supply lubricating oil thereto through a plug orifice 316 which acts as a control orifice.

A short longitudinally extending passageway 318 is open at opposite ends thereof to intersect the cross drilled passageway 310 in the primary crank shaft rear part 126*a* so as to provide a supply of oil into the interior hollow regions 232 of the secondary crank shaft 142. Part of this oil supply flows between the clearance bushing 240 located in the bottom 236 of the secondary crank shaft and the bottom cylindrical portion of the eccentric cavity to lubricate the inboard secondary crank shaft bearing 154. The remainder of the oil supply enters directly into the internal hollow region 232 of the secondary crank shaft 142 where it flows into the hollow region 270 of output shaft 124 through cross drilled passageway 268 in the offset crank portion 254 of the second crank shaft. From the hollow output shaft, the oil flows through the rotary union 274 into the flexible line 278 where it is directed into a longitudinally extending passageway 320 within the connecting 262 link to lubricate the clevis 14 and link pin 282 through clearance bushing 280.

The foregoing arrangement of oil passageways and clearance bushings provides a simple yet effective means for lubricating all rotary parts of the crank shaft drive unit 120 without the need for superfluous flexible supply lines and rotary unions.

A flywheel 350 is mounted to the outer surface of the input shaft housing 134 by means of bearings 352 as depicted in FIG. 7. A commercially available air-operated combined disc clutch/brake 355 used to start and stop crank drive unit 120 (and therefore ram 12) is mounted to input shaft 122 to interconnect both motor M through belt 401 and flywheel 350 to the input shaft. An air rotary union (not shown) located at the rear end of input shaft 122 supplies pressurized air to the clutch/-brake mechanism to selectively engage the brake and clutch components to interconnect the flywheel and motor drive unit M to the input shaft 122 in the following manner. For example, to commence operation of the crank drive unit 120, there is initially no air pressure applied to the clutch/brake; i.e., the brake is engaged and the clutch is declutched so that the flywheel is free to spin. Rotation of motor drive unit M then commences to drive the flywheel through the belt. At this time, the flywheel 350 is de-clutched and therefore not engaged to the input shaft 122 but will nonetheless commence spinning (due to interconnection to the motor by belt 401) as motor drive unit M moves the belt. After the flywheel 350 has reached a predetermined rotational speed, the brake is released and the clutch engaged by applying air pressure to the clutch/-brake unit to drive the primary crank shaft and therefore all rotating parts. Energy is therefore transferred by the clutch/brake from the flywheel to the crank drive mechanism. During this transfer, the flywheel slows slightly but is sized so that only a small speed drop occurs as the machine is accelerated to operating speed.

To stop crank drive unit 120, the flywheel is declutched to disengage from the input shaft 122. The flywheel 350 continues to spin but no longer transfers its momentum to rotate primary crank shaft 126. The brake is then applied to the input shaft 122 to stop the crank drive.

Flywheel 350 is typically sized to have to approximately fifteen times the inertia of the crank drive 120. Flywheel 350 is necessary to supply the large amounts of energy used to form the cans C in a very short time. The sizing of the flywheel is such that minimal speed fluctuation occurs within ram 12 during high speed reciprocation. The clutch is necessary so that the entire machine including flywheel 350 does not have to start and stop in synchronism with each other. The clutch provides much quicker start times and greatly improves braking action. Quick braking is important since severe damage to the tooling dies 25 may occur if additional blanks are fed into the tooling from a machine stopping sequence that generates several additional machine strokes. In other words, with the clutch brake mechanism in the present invention, the flywheel may be quickly de-clutched and the crank drive stopped via the brake when the ram is in its return stroke so as to prevent the ram from completing the next working stroke that may cause the aforesaid damage to the tooling dies 25 to occur.

Figure 10:
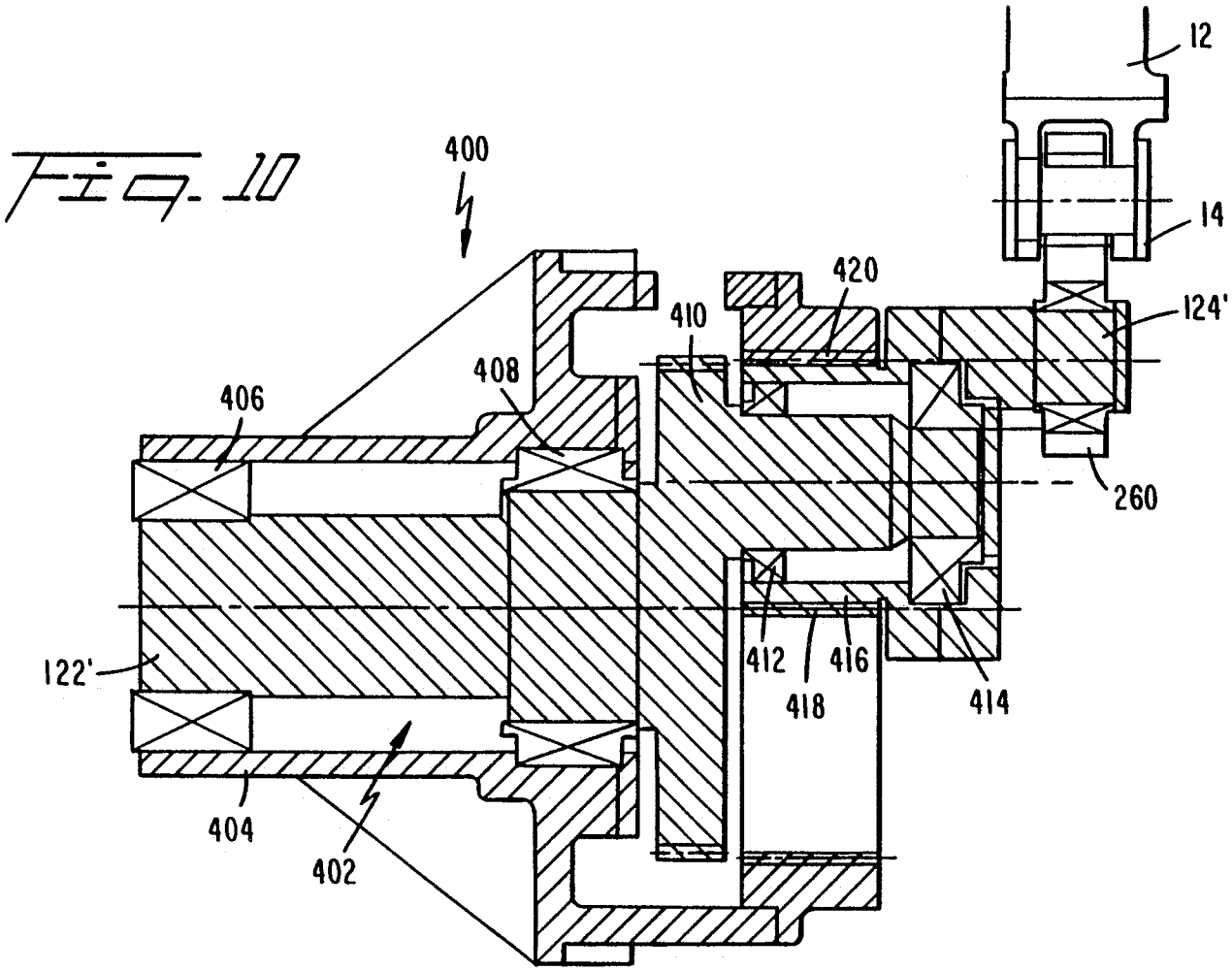
FIGS. 10–12 are schematic sectional views of second, third and fourth embodiments of the crank drive mechanism.
Figure 11:
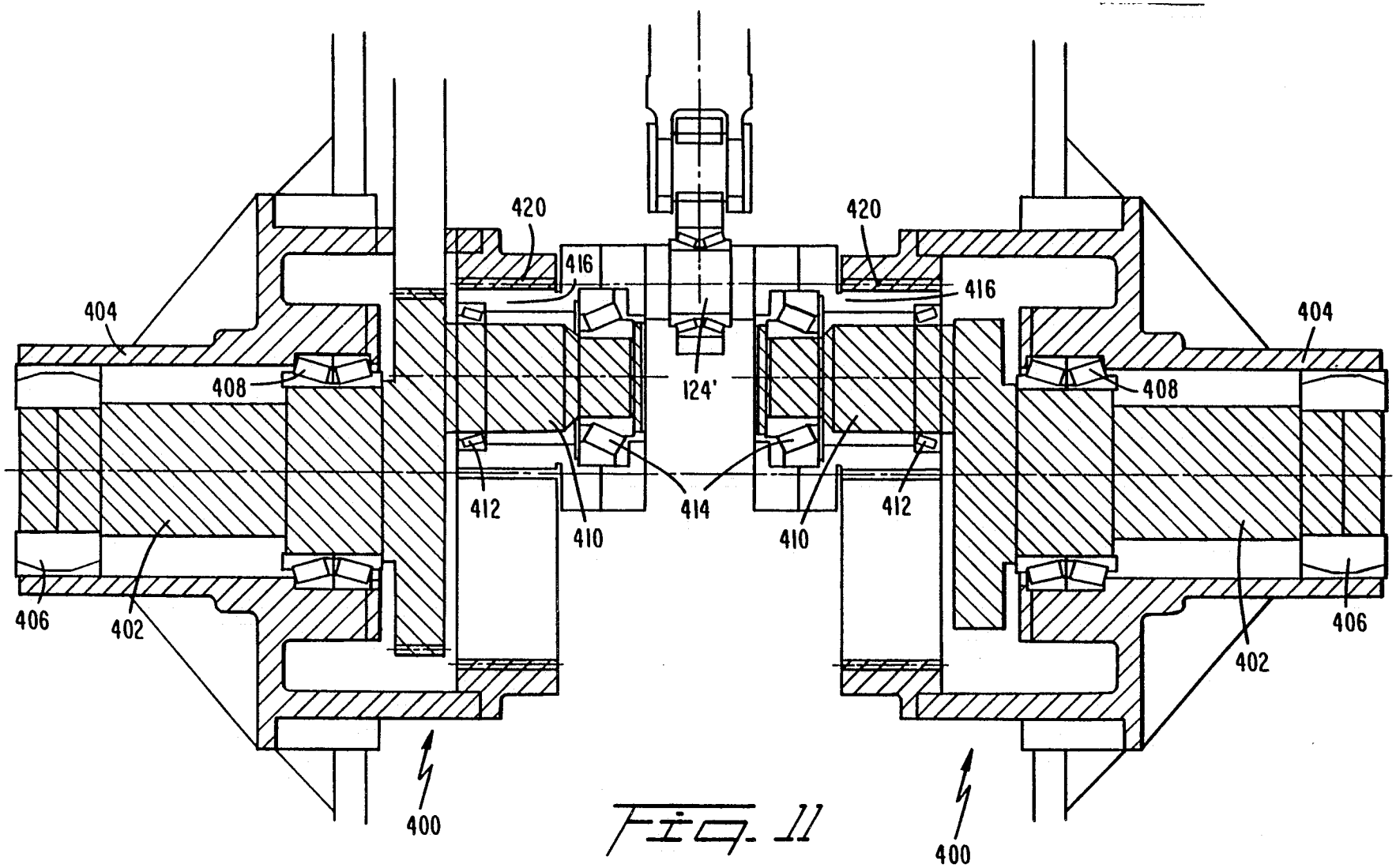
Figure 12:
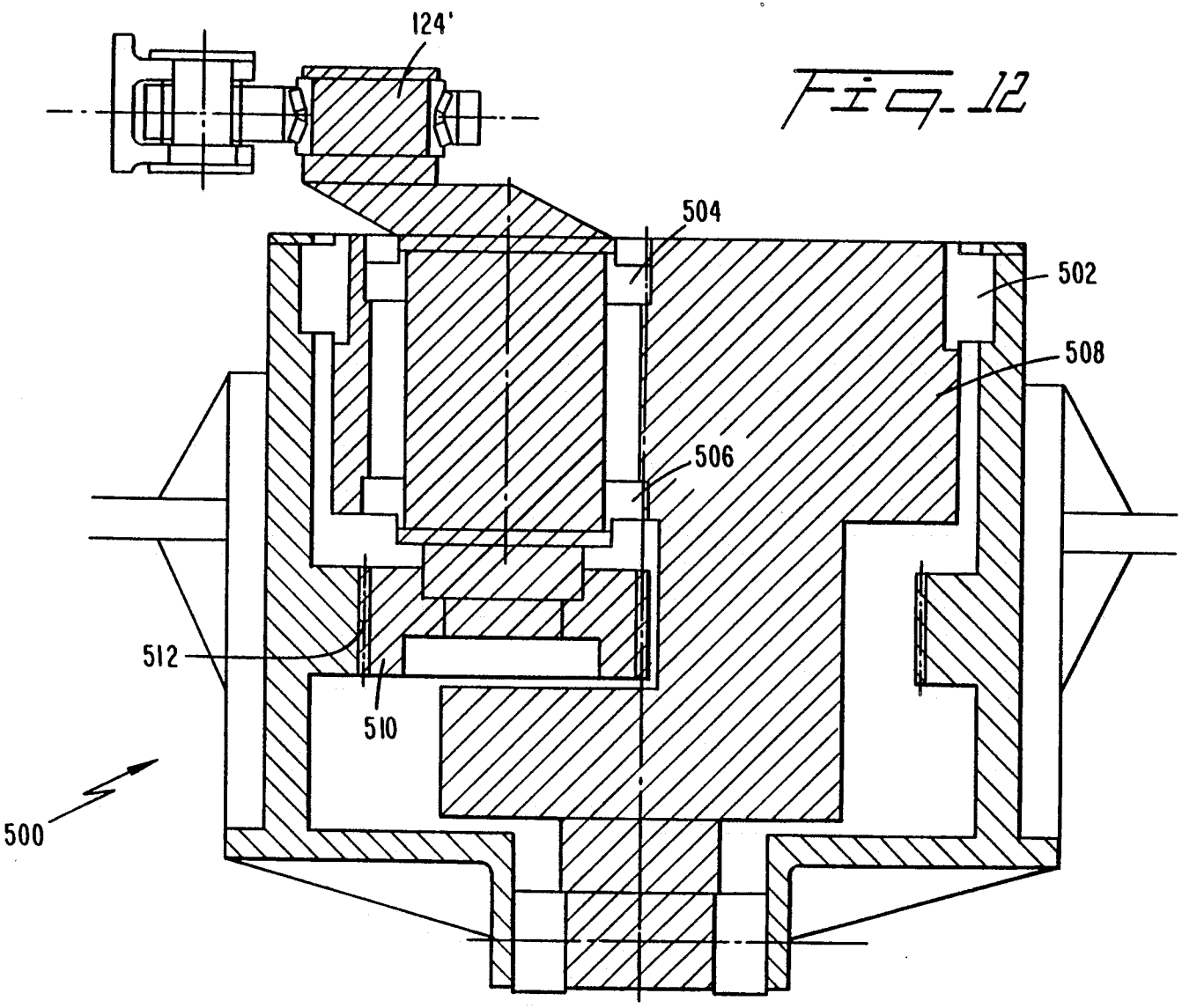

FIGS. 10–12 are schematic illustrations of other embodiments of a crank drive mechanism developed by the present inventors and operating in accordance with traditional cardan gear principles to convert rotary motion of an input shaft 122' into straight line motion A of an output shaft 124'. Although not as efficient in design in certain applications as the crank drive mechanism 120 of the present invention discussed supra, these alternate embodiments are nonetheless deemed to fall within the scope of the present invention and essentially constitute first, second and third generation designs resulting in the crank drive mechanism discussed supra.

With reference to FIG. 10, the first generation crank drive mechanism 400 essentially comprises a primary crank shaft 402 with its rearwardly extending portion rotatably mounted to the crank shaft housing 404 with inboard and outboard primary crank shaft bearings of substantially the same diameter 406 and 408. The forward portion of the primary crank shaft, located forwardly of the outboard primary crank shaft bearing 408, is formed with an eccentrically offset portion 410 effectively defining an offset primary crank or throw on the primary crank shaft. Another pair of bearings 412 and 414 mounted to this primary crank 410 supports a tube 416 having gear teeth 418 on its rearwardly extending exterior that defines a pinion meshing with the inner teeth of a stationary ring gear 420. The forwardly extending portion of the tube 416 defines the offset output shaft 124' of the crank drive mechanism 400.

In this embodiment, the mechanism 400 generates straight line motion of the eccentric output shaft 124' but this straight line motion is easily deflected by the applied loads due to bearing placement, particularly with respect to the inboard and outboard primary crank shaft bearings 406,408 within the rear portion of the crank shaft housing 400. These loads distort the straight line motion and generate high bearing loads which may possibly disrupt gear tooth contact. Due to the placement of the inboard and outboard primary crank shaft bearings 406,408, the resulting high cantilever ratio (i.e., between the outboard primary bearing and output shaft 124') more than doubles the applied load at the outboard primary crank shaft bearing vis-a-vis the crank shaft design of the preferred embodiment.

In FIG. 11, the crank drive mechanism 400 of FIG. 10 is mirrored and, by duplicating the mechanism of FIG. 10 in the design of FIG. 11, the loads on all parts are effectively halved. Nonetheless, the remaining loads applied to the bearings still result in a relatively high cantilever ratio and this problem may be compounded by the difficulty in driving both sides at equal speed.

The alternate embodiment 500 of FIG. 12 is somewhat similar to the preferred embodiment of FIG. 7 discussed supra, due to its use of a large outboard primary crank shaft bearing 502 and the placement of the secondary crank shaft bearings 504 and 506 within the primary crank shaft 508. With the mechanism of FIG. 12, the cantilever forces acting on the output shaft are greatly reduced. However, in this design 500, the pinion 510 and ring gear 512 are located rearwardly of the secondary crank shaft bearing sets 504,506 and therefore tends to induce some undesirable cantilever forces acting on the output shaft 124'. There are also severe assembly difficulties associated with the FIG. 12 embodiment due to the location of the pinion 510 and stationary ring gear 512.

According to the principles of the present invention, therefore, apparatus for forming one-piece metallic can bodies is provided wherein the reciprocal ram 12 performing the working operation is mechanically driven by the crank drive mechanism 120 to gain the inherent, high speed rotary operational advantages of a cardan gearing mechanism uniquely modified to (1) minimize and virtually negate cantilevering forces that would otherwise induce undesirable deflection of the working end 18 of the ram in a horizontal plane and possibly prevent exact high speed registry of the ram and metallic can bodies C' into the forming dies 25 and (2) minimize excessive bearing loads and interior bending of the rotating parts resulting in early bearing fatigue and failure. Deflection of the overhanging working end 18 of the ram 12 in a vertical plane is advantageously avoided by the provision of a center hydrostatic bearing 32 with means to impart either a constant or variable downward force against the ram through the center bearing to produce a desired deflection in the ram between the end hydrostatic bearings 34,36 to counteract the forces of gravity acting on the overhanging working end portion and effectively negate undesirable downward deflection of the working end of the ram. Also, due to the unique hydrostatic type pressurized oil film bearing assemblies for supporting the ram horizontally forwardly and rearwardly in carrying out its reciprocal working and return strokes, and the provision of the stepped ends and lands formed at opposite ends of each bearing 32,34,36, the bearings advantageously perform as both hydrodynamic bearings or as hydrostatic bearings as a function of the reciprocating speed of the ram.

Still further according to the principles of the present invention, placement of the large diameter stationary ring gear and the large diameter outboard primary crank shaft bearing adjacent the path of straight line motion advantageously enables the working stroke of the ram to be increased to a length equal to the pitch diameter of the ring gear so as to enable the crank drive mechanism and ram to be used for manufacturing metallic can bodies of longer length without sacrificing the exact registry conditions necessary for insertion of the ram through the forming dies 25. Likewise, the ability to effectively prevent or minimize undesirable downward deflection of the overhanging working end of the ram by the application of a variable or constant force to the center bearing of the hydrostatic bearing system enables the ram itself to be inherently capable of forming metallic can bodies of greater length vis-a-vis other rams formed without a bearing system having the capability of being loaded with a constant or variable force to counteract downward deflection of the overhanging portion.

Optimally, the ram and crank drive mechanism according to the present invention are used in combination with each other to attain all objects and advantages of the present invention. However, in accordance with the invention, the ram and hydrostatic bearing system thereof of the invention may be used independently of the crank drive mechanism of the invention and therefore with other types of ram mechanical drive assemblies. Conversely, the unique crank drive mechanism of the present invention may be used with other types of rams or in other applications wherein the ability to convert a rotational force into a straight line reciprocating high speed output motion is desirable.

Accordingly, it will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. Apparatus for forming metallic parts, comprising:

(a) a reciprocating ram;

(b) a die package positioned at the forward end of the working stroke of the ram in conical alignment with the straight line axis of motion of the ram;

(c) means for driving the ram in its forward and rearward reciprocating strokes, said ram being adapted for having a metal part positioned to be engaged by a forward working end of the ram and formed by said working end in its working stroke by being directed through the die package with the working end; said ram being supported for sliding reciprocating movement in a hydrostatic bearing system including at least a pair of hydrostatic bearings; wherein said working end, in the extended position of said ram from said bearings in the working stroke, defines an unsupported, overhanging portion; and (d) means for applying a deflection force against the ram, between the bearings, to induce a desired degree of deflection in said working end and thereby maintain said working end in substantially perfectly centered alignment with the die package.

2. The apparatus of claim 1, wherein said deflection force applying means is a substantially constant force applied to the ram independent of the position of the ram working end in its working or return strokes.

3. Apparatus of claim 1, wherein said deflection force applying means is a variable force applied to the ram as a function of its position in the working and return strokes.

4. Apparatus of claim 1, wherein said overhanging working end tends to bend downwardly from the plane of movement of the ram as a result of the unsupported weight of said working end, and wherein said deflection force applying means is applied downwardly between the bearings to cause the ram to bend upwardly between the point of application of the force and the working end to thereby deflect the working end upwardly back towards the plane of movement.

5. Apparatus of claim 4, further including a center bearing between said pair of bearings, said deflection force applying means applying said deflection force against the center bearing.

6. Apparatus of claim 1, wherein said hydrostatic bearing system includes a bearing housing assembly, said pair of bearings including front and rear end bearings respectively mounted at opposite ends of the housing.

7. Apparatus of claim 6, wherein each front and rear bearing includes a bearing sleeve and a concentric bushing within the sleeve through which the ram is adapted to reciprocate, an inner cylindrical surface of each bushing including a plurality of circumferentially spaced slots extending longitudinally in the direction of ram movement and means for supplying pressurized oil to each slot to thereby define elongate hydrostatic pressure pads opposing the outer surface of the ram.

8. Apparatus of claim 7, wherein opposite ends of each hydrostatic pressure pad slot are closed, and further including a plurality of longitudinally extending drain slots respectively disposed between the hydrostatic pressure pad slots, said drain slots adapted to receive the pressure oil flowing circumferentially therein from the pressure pad slots and which drain slots open at opposite ends thereof to the interior of the housing to enable recirculation of the pressure oil.

9. Apparatus of claim 8, further including hydraulic supply device means formed with control orifice means and mounted within the bearing housings for supplying pressure oil to the hydrostatic pressure pad slots through interconnecting supply passageways formed in the bearing housing and sleeve and bushing, whereby the pressure oil flows through the control orifice of each device which, when the ram is centered, applies a predetermined pressure drop to the oil which then enters each hydrostatic pressure pad slot through the appropriate passageways, the oil being constrained to flow circumferentially from the pressure pads to the adjacent drain slots and experiencing a pressure drop to substantially zero at the drain slot with the resulting pressure distribution creating a force that lifts and centers the ram.

10. Apparatus of claim 9, wherein the end portion of each bushing has a decreased bushing inner diameter in relation to the intermediate larger inner diameter portion of the bushing between the end portions, said decreased diameter end portion effectively functioning as a dam to minimize axial oil flow to thereby ensure improved bearing support during reciprocating ram movement.

11. Apparatus of claim 10, wherein said decreased diameter end portions define stepped ends establishing hydrodynamic end sections in each bearing, whereby when the axial velocity of the ram is at a predetermined low speed, the combination of the hydrostatic pressure pad slots and the drain slots center the ram and below which predetermined low speed said hydrodynamic sections have substantially no hydrodynamic effect, and wherein when the ram velocity is above said predetermined low speed, at which speeds the axial flow of oil through the bearing tends to disrupt hydrostatic performance by interfering with the circumferential flow of oil, said axial flow creates a hydrodynamic step proximate the hydrodynamic sections which provide a centering force maintaining the ram in its substantially centered position until the ram velocity drops to or below said predetermined low speed at which speeds the hydrostatic sections again become effective.

12. Apparatus of claim 11, further including a center or intermediate bearing formed with an arrangement of hydrostatic pressure pad slots, drain slots and hydrodynamic sections substantially identical to the corresponding parts of the end bearings.

13. Apparatus of claim 11, further including a center or intermediate bearing between the end bearings, said intermediate bearing including a pair of bushings longitudinally spaced from each other on the ram, each bushing having an inner surface formed with stepped ends corresponding to the stepped ends of the bushings in the end bearings, each bushing of the intermediate bearing being also formed with a plurality of circumferentially spaced hydrostatic pressure pad slots and plural drain slots corresponding to the structure and distribution of the drain and pressure pad slots in the bushings of the end bearings.

14. Apparatus of claim 13, wherein opposing inner end faces of the intermediate bearing bushings are spaced from each other to provide a clearance enabling the drain slots to drain oil from the intermediate bearing bushings into a vertical passageway formed in the intermediate bearing sleeve housing the bushings and in alignment with an exhaust oil adapter in the bearing housing.

15. Apparatus of claim 14, further comprising two sets of hydraulic supply device means respectively provided for supplying high pressure oil to each of the plural hydrostatic pressure pad slots in each intermediate bearing bushing, each said hydraulic supply device means being slidably mounted within openings formed in an upper portion of the bearing housing wall with sliding sealing contact between the supply device and its associated opening, the lower end of each hydraulic supply device means being in threaded contact with a tapped bore formed in an upper portion of the associated bearing sleeve and flow passageways in the bearing sleeve and bushing for communicating with the respective hydrostatic pressure pad slot and the associated hydraulic supply device means.

16. Apparatus of claim 15, further including retaining means within the bearing housing for retaining the intermediate bearing in an axially stationary position within the housing while enabling the bearing to be movable in a floating state in the radial direction by virtue of a clearance provided between an outer surface of the intermediate bearing sleeve and opposing inner surfaces of the bearing housing.

17. Apparatus of claim 16, wherein said deflection force applying means includes at least one cylinder mounted in the bearing housing wall and having a piston rod extending through the housing into contact with the intermediate bearing sleeve, whereby actuation of the cylinder extends the piston rod to produce a deflection force or load against an upper surface of the bearing sleeve which is transmitted to the reciprocating ram through the intermediate bearing bushings so as to force the ram to "bow" downward between the end support bearings to create an upward deflection of the ram within the end bearings that tends to lift the overhanging end portion of the ram.

18. Apparatus of claim 17, wherein said driving means includes:

(a) a rotatable input shaft;
(b) an output shaft moving in a reciprocating straight line path connected to the ram; and
(c) cardan gearing means for converting rotation of said input shaft into reciprocating straight line motion of said output shaft.

19. Apparatus of claim 11, wherein said driving means includes:

(a) a rotatable input shaft;
(b) an output shaft moving in a reciprocating straight line path connected to the ram; and
(c) cardan gearing means for converting rotation of said input shaft into reciprocating straight line motion of said output shaft.

20. Apparatus of claim 1, wherein said driving means includes:

(a) a rotatable input shaft;
(b) an output shaft moving in a reciprocating straight line path connected to the ram; and
(c) cardan gearing means for converting rotation of said input shaft into reciprocating straight line motion of said output shaft.

21. Apparatus of claim 1, wherein said driving means includes cardan type gearing means having;

(a) a crank shaft housing means;
(b) a primary crank shaft means mounted by a pair of inboard and outboard bearings in said crank shaft housing means and rotatable about a drive axis L1 by an input shaft at an inboard end thereof;
(c) a secondary crank shaft means eccentrically mounted to said primary crank shaft means for rotation about axis L1 and having an axis of rotation L2 which is parallel and offset from axis L1;
(d) a stationary ring gear mounted in said crank shaft housing means;
(e) pinion means mounted on the secondary crank shaft means in meshing contact with the stationary ring gear; and
(f) an output shaft mounted to a crank portion of the secondary crank shaft;

whereby rotation of the primary crank shaft about its rotational axis L1 causes said pinion means to roll along the ring gear and thereby rotate the secondary crank shaft about axis L2 in a rotational direction opposite the rotational direction of the primary crank shaft, while revolving about axis L1 such that the combined motions of the primary crank shaft and secondary crank shaft and pinion means result in straight line motion of the output shaft.

22. Apparatus of claim 23, wherein said outboard primary crank shaft bearing is mounted in the crank shaft housing means at a forward end thereof adjacent the path of straight line motion of the output shaft and ram.

23. Apparatus of claim 22, wherein the pitch diameter of the pinion means and the pitch diameter of the ring gear are in the ration of 1:2, and wherein the output axis of the eccentric output shaft lies on the pitch circle of the pinion means so as to enable straight line motion of said output shaft to occur in accordance with cardan gearing principles.

24. Apparatus of claim 23, wherein a forward body portion of the primary crank shaft is formed with a longitudinally extending cylindrical cavity having an eccentric, central longitudinal axis L2, said cavity receiving said secondary crank shaft thereby mounted for rotation within the primary crank shaft.

25. Apparatus of claim 24, wherein body portions of the primary crank shaft defining the cavity and extending transversely or radially towards axis L1 effectively constitutes a primary or first crank arm of integral construction with the primary crank shaft.

26. Apparatus of claim 25, wherein said secondary crank shaft is rotatably mounted at an inboard, smaller diameter end thereof within the bottom of the eccentric cavity with a rear or inboard secondary crank shaft roller element bearing received in the cavity, said secondary crank shaft extending longitudinally forwardly within the eccentric cavity and having a large diameter forward portion thereof rotatably mounted by means of an outboard or front, secondary crank shaft roller element bearing within a cylindrical forward portion of the cavity formed in a forward portion of the primary crank shaft, said inboard and outboard secondary crank shaft bearings thereby each being mounted within the primary crank shaft.

27. Apparatus of claim 26, wherein said outboard secondary crank shaft bearing is generally coplanar and radially inwardly spaced from the outboard primary crank shaft bearing to reduce bearing loads during rotation of the primary crank shaft.

28. Apparatus of claim 27, wherein said pinion means projects laterally outwardly from an opening formed in the side wall of the primary crank shaft defining the secondary crank shaft mounting cavity.

29. Apparatus of claim 27, wherein an eccentric throw or second crank arm of the secondary crank shaft defines the front end thereof and is located forwardly of the primary crank shaft and crank shaft housing and eccentrically offset with respect to the remaining portion of the secondary crank shaft within the primary crank shaft, said output shaft being formed at the offset distal end of the second crank arm.

30. Apparatus of claim 29, wherein the pitch diameter of the ring gear defines the length of the output shaft stroke, wherein the diameter of the outboard primary crank shaft bearing is larger than the ring gear diameter to thereby enable close positioning of the said bearing adjacent the path of straight line motion to thereby virtually eliminate overhanging loads between said outboard bearing and the output shaft.

31. Apparatus of claim 30, wherein said primary crank shaft is of two-part construction formed with a rear part perfectly centered on drive axis L1 and which defines the input shaft, and wherein the primary crank shaft front part is of larger diameter than the rear part and houses the secondary crank shaft and inboard and outboard secondary crank shaft bearings.

32. Apparatus of claim 31, wherein said first part is made of a lighter material than the rear part to thereby reduce the moment of inertia of the rotating parts and reduce bearing fatigue.

33. Apparatus of claim 32, further comprising a pair of balancing counter-weights respectively secured to the front face of the primary crank shaft and the second crank arm of the secondary crank shaft extending transversely and forward of the primary crank shaft, said counter-weights rotating with their respective shafts and being positioned to substantially eliminate any external inertial forces and any overhanging loads created by the mass of the eccentric secondary crank arm during operation.

34. Apparatus of claim 33, wherein said primary crank shaft counter-weight is a truncated sector defined by an outer circumferential edge generally coextensive with the circumference of the primary crank shaft housing and an inner circumferential edge secured to the front face at a portion of the primary crank shaft diametrically opposed to the secondary crank shaft.

35. Apparatus of claim 34, wherein the secondary crank shaft counter-weight is also of truncated sector shape and is formed with an outer circumferential edge having substantially the same radius of curvature as the inner circumferential edge of the primary crank shaft counter-weight and an inner circumferential edge secured to the front face of the offset second crank arm of the secondary crank shaft.

36. Apparatus of claim 35, wherein said primary and secondary crank shaft counter-weights are substantially coplanar and the mass and centroid of the primary crank shaft counter-weight is selected such that when the reciprocating ram attached to the output shaft of the secondary crank shaft, substantially all horizontal imbalancing forces are cancelled, and wherein the secondary crank shaft counter-weight and the mass and centroid thereof are selected to substantially entirely remove all vertical imbalancing forces during operation of the crank drive unit.

37. Apparatus of claim 36, wherein the centroid of the secondary crank shaft counter-weight is approximately $\frac{1}{4}$ of the ram stroke away from the center line axis L2 of the secondary crank shaft and the mass of the secondary crank shaft counter-weight is about equal to the mass of the reciprocating ram.

38. Apparatus of claim 37, further comprising an input shaft housing mounted to the rear of the crank shaft housing and centering the primary crank shaft rear part and inboard primary crank shaft bearing therefor, and passageway means formed in each of the crank shaft housing, the input shaft housing, the front and rear parts of the primary crank shaft and the secondary crank shaft including the secondary crank arm and the output shaft, for distributing pressurized lubricating oil throughout the apparatus, said passageway means including first passageway means extending through the back wall of the crank shaft housing and second passageway means, in the input shaft housing, having one end connected to the first passageway means and a second end terminating in communication with an annular groove formed on the primary crank shaft rear part and intersecting a clearance bushing formed between the primary crank shaft rear part forward end and the input shaft housing, said clearance bushing enabling lubricating oil supplied from the first and second passageway means to flow into the inboard primary crank shaft bearing located at one end of the clearance bushing and to also flow into the crank shaft housing for lubrication of the stationary ring gear, pinion means and outboard primary crank shaft bearing, further including a cross passageway extending through the rear part with opposite ends communicating with the annular groove, further including return passageway means formed longitudinally in the input shaft housing wall having one end communicating with the rear portion of the inboard primary crank shaft bearing and a second forward end communicating with the crank shaft housing interior to direct lubricating oil from the inboard primary crank shaft bearing into the crank shaft housing, further including third passageway means in the primary crank shaft front part and a portion of the rear part intersecting the cross passageway for directing oil to the outboard secondary crank shaft bearing, and fourth passageway means in the front part communicating with the cross passageway for directing oil into the eccentric cavity and around a clearance bushing housed in the rear end of the secondary crank shaft to lubricate the inboard secondary crank shaft bearing, said fourth passageway means also directing oil into a hollow region of the secondary crank shaft and fifth passageway means formed in the second crank arm of the secondary crank shaft for directing oil from within the hollow region of the secondary crank shaft into the output shaft, and means for supplying oil entering the output shaft to the clevis pin means connecting the output shaft to the reciprocating ram.

39. The apparatus of claim 1, wherein said hydrostatic bearing system includes a housing containing said bearings through which the ram extends, an air tube extending through the ram in communication with the working end, a manifold stationarily mounted to the housing proximate the rear end of the working ram, passageway means in the rear end of the ram adapted to align with the manifold when the working end of the ram is in its front dead center position, and one-way check valve means in the rear end of the working ram to transmit pressurized air from the manifold through the passageway means through the ram and into the working end thereof to propel a formed can blank from the ram working end prior to commencement of the return stroke of the ram.

40. The apparatus of claim 39, wherein said check valve means remains closed to prevent reverse flow of pressurized air until opened by inertial forces acting on the check valve means as the ram moves through a center portion of its return stroke.

41. Apparatus for forming metallic parts, comprising: a reciprocating ram; means for driving the ram in forward and rearward reciprocating strokes, said ram being adapted for having a metal part positioned to be engaged by a forward, working end of the ram and formed by said working end in its working stroke; and said ram being supported for sliding reciprocating movement in a hydrostatic bearing system including at least a pair of hydrostatic bearings disposed in opposite end portions of a bearing housing assembly, each bearing including a bearing sleeve and a concentric bushing within the sleeve through which the ram is adapted to reciprocate, an inner cylindrical surface of each bushing including a plurality of circumferentially spaced slots extending longitudinally in the direction of ram movement and means for supplying pressurized oil to each slot to thereby define elongate hydrostatic pressure pads opposing the outer surface of the ram, and further including a plurality of longitudinally extending drain slots respectively disposed between the hydrostatic pressure pad slots, said drain slots adapted to receive the pressure oil flowing circumferentially therein from the pressure pad slots and which drain slots open at end portions thereof to the interior of the housing to enable recirculation of the pressure oil, and wherein each bearing bushing at ends thereof is formed with a stepped portion defined by an end diameter portion of the bearing having a smaller diameter than an interior diameter portion of the bushing located adjacent thereto to define hydrodynamic stepped end sections at opposite ends of each bushing that limit axial flow of pressurized oil through the bearing, between the bushing and ram outer surface, when the ram velocity is above a predetermined speed, and means for applying a deflection force against the ram, between the bearings, to induce a desired degree of deflection in said working end.

42. In a bearing system supporting a reciprocating ram supported for sliding reciprocating movement in a hydrostatic bearing system including a housing and at least a pair of hydrostatic bearings therein, wherein the working end of said ram, in the extended position of said ram from said bearings in the working stroke, defines an unsupported, overhanging portion; the improvement comprising means, mounted to the bearing housing, for applying a deflection force against the ram, between the bearings, to induce a desired degree of deflection in said working end.

43. In a bearing system supporting a reciprocating ram supported for sliding reciprocating movement in a hydrostatic bearing system including a housing and at least a pair of hydrostatic bearings therein, wherein the working end of said ram, in the extended position of said ram from said bearings in the working stroke, defines an unsupported, overhanging portion, the improvement comprising: said ram being supported for sliding reciprocating movement in a hydrostatic system including at least a pair of hydrostatic bearings disposed in opposite end portions of a bearing housing assembly, each bearing including a bearing sleeve and a concentric bushing within the sleeve through which the ram is adapted to reciprocate, an inner cylindrical surface of each bushing including a plurality of circumferentially spaced slots extending longitudinally in the direction of ram movement and means for supplying pressurized oil to each slot to thereby define elongate hydrostatic pressure pads opposing the outer surface of the ram, and further including a plurality of longitudinally extending drain slots respectively disposed between the hydrostatic pressure pad slots, said drain slots adapted to receive the pressure oil flowing circumferentially therein from the pressure pad slots and which drain slots open at end portions thereof to the interior of the housing to enable recirculation of the pressure oil, and wherein each bearing bushing at ends thereof is formed with a stepped portion defined by an end diameter portion of the bearing having a smaller diameter than an interior diameter portion of the bushing located adjacent thereto to define hydrodynamic stepped end sections at opposite ends of each bushing that limit axial flow of pressurized oil through the bearing, between the bushing and ram outer surface, when the ram velocity is above a predetermined speed, and means for applying a deflection force against the ram, between the bearings, to induce a desired degree of deflection in said working end.

* * * * *